US012319984B2

(12) United States Patent
Luo et al.

(10) Patent No.: US 12,319,984 B2
(45) Date of Patent: Jun. 3, 2025

(54) METAL MATRIX COMPOSITES AND METHODS OF MAKING AND USE THEREOF

(71) Applicant: Ohio State Innovation Foundation, Columbus, OH (US)

(72) Inventors: Aihua Luo, Columbus, OH (US); Xuejun Huang, Pflugerville, TX (US); Jianyue Zhang, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 17/988,888

(22) Filed: Nov. 17, 2022

(65) Prior Publication Data

US 2023/0160038 A1 May 25, 2023

Related U.S. Application Data

(60) Provisional application No. 63/281,765, filed on Nov. 22, 2021.

(51) Int. Cl.
*C22C 1/04* (2023.01)
*B22D 11/114* (2006.01)
(Continued)

(52) U.S. Cl.
CPC ..... *C22C 1/0416* (2013.01); *B22D 11/114* (2013.01); *B22F 1/148* (2022.01);
(Continued)

(58) Field of Classification Search
CPC ..... C22C 1/0416
See application file for complete search history.

(56) References Cited

U.S. PATENT DOCUMENTS 11,168,385 B2 11/2021 Luo et al.
2011/0250090 A1* 10/2011 Naveau ..... B22D 11/108 164/459
2018/0119255 A1 5/2018 Luo et al.

FOREIGN PATENT DOCUMENTS

CN 104388764 B 5/2016
CN 104862510 B 9/2016
(Continued)

OTHER PUBLICATIONS

Adamiak M et al. Mechanically milled AA6061/(Ti3Al)p MMC reinforced with intermetallics—the structure and properties, Journal of Materials Processing Technology, 155-156 (2004) 2002-2006.
(Continued)

*Primary Examiner* — Christopher S Kessler
(74) *Attorney, Agent, or Firm* — Meunier Carlin & Curfman LLC

(57) ABSTRACT

Disclosed herein are metal matrix composites and methods of making and use thereof. For example, disclosed herein are methods of making a metal matrix composite comprising a metal matrix reinforced by a high entropy alloy. The methods comprise mixing a first powder and a second powder to form a powder mixture, wherein the first powder comprises a plurality of particles comprising a metal and the second powder comprises a plurality of particles comprising a high entropy alloy. The methods further comprise compacting the powder mixture to form a pellet and adding the pellet to a molten metal, the molten metal comprising the metal in a molten state, thereby melting the pellet to form a molten mixture. The methods further comprise subjecting the molten mixture to an ultrasonic treatment and casting the ultrasonic treated mixture to form the metal matrix composite.

11 Claims, 18 Drawing Sheets

(51) Int. Cl.

| | |
|---|---|
| ***B22F 1/148*** | (2022.01) |
| ***C22C 1/02*** | (2006.01) |
| ***C22C 21/10*** | (2006.01) |
| ***C22C 23/00*** | (2006.01) |

(52) U.S. Cl.
CPC ..... *C22C 1/026* (2013.01); *C22C 21/10* (2013.01); *C22C 23/00* (2013.01)

(56) References Cited

FOREIGN PATENT DOCUMENTS

| | | | |
|---|---|---|---|
| CN | 108723371 | A | 11/2018 |
| CN | 109338172 | A | 2/2019 |
| CN | 109457197 | A | 3/2019 |
| CN | 110284032 | A | 9/2019 |
| CN | 110523997 | A | 12/2019 |

OTHER PUBLICATIONS

Asthana R et al. A Study of Metal-Ceramic Wettability in SiC—Al Using Dynamic Melt Infiltration of SiC, Key Eng. Mater. 80 (1993) 47-62. https://doi.org/10.4028/www.scientific.net/KEM.79-80.47.
Bhoi NK et al. Developments in the aluminum metal matrix composites reinforced by micro/nano particles—A review, J. Compos. Mater. 54 (2020) 813-833. https://doi.org/10.1177/0021998319865307.
Chen J et al. Fabrication and mechanical properties of AlCoNiCrFe high-entropy alloy particle reinforced Cu matrix composites, J. Alloys Compd. 649 (2015) 630-634. https://doi.org/10.1016/j.jallcom.2015.07.125.
Choi Y et al. Fabrication of metal matrix composites of TiC—Al through self-propagating synthesis reaction, Metallurgical Transactions A, 23 (1992) 2387-2392.
Chung WS et al. Ni-Coated SiC Reinforced Aluminum Composites Processed By Vacuum Infiltration, Mater. Res. Bull. 31 (1996) 1437-1447.
Drew RAL et al. The influence of nickel coating on the wettability of aluminum on ceramics, Composites Part A: Applied Science and Manufacturing, 33 (2002) 1429-1432.
Fan X. et al. The microstructural evolution of an Al—Zn—Mg—Cu alloy during homogenization, Mater. Lett. 60 (2006) 1475-1479. https://doi.org/10.1016/j.matlet.2005.11.049.
Ghasali E et al. Vanadium carbide reinforced aluminum matrix composite prepared by conventional, microwave and spark plasma sintering, J. Alloys Compd. 688 (2016) 527-533. https://doi.org/10.1016/j.jallcom.2016.07.063.
Gong D et al. Stable second phase: The key to high-temperature creep performance of particle reinforced aluminum matrix composite, Mater. Sci. Eng. A. 770 (2020) 138551. https://doi.org/10.1016/j.msea.2019.138551.
Guan HD et al. Aluminum matrix composites reinforced with metallic glass particles with core-shell structure, Mater. Sci. Eng. A. 771 (2020) 138630. https://doi.org/10.1016/j.msea.2019.138630.
Guo B et al. Achieving high combination of strength and ductility of Al matrix composite via in-situ formed Ti—Al3Ti core-shell particle, Mater. Charact. 170 (2020) 110666. https://doi.org/10.1016/j.matchar.2020.110666.
Guo X et al. Interfacial strength and deformation mechanism of SiC—Al composite micro-pillars, Scr. Mater. 114 (2016) 56-59. https://doi.org/10.1016/j.scriptamat.2015.11.018.
Han Q. Ultrasonic processing of materials. Metallurgical and Materials Transactions B, 2015, 46(4), 1603-1614.
Huang X et al. Lightweight AlCrTiV high-entropy alloys with dual-phase microstructure via microalloying, J. Mater. Sci. 54 (2019) 2271-2277. https://doi.org/10.1007/s10853-018-2970-4.
Issa HK et al. Development of an aluminum/amorphous nano-SiO2 composite using powder metallurgy and hot extrusion processes, Ceram. Int. 43 (2017) 14582-14592. https://doi.org/10.1016/j.ceramint.2017.06.057.
Ji F et al. Creep behavior of in situ TiCP/2618 aluminum matrix composite, Mater. Sci. Eng. A. 506 (2009) 58-62. https://doi.org/10.1016/j.msea.2008.11.010.
Kumar S et al. Effect of Temperature on the Wear Behavior of Al—7Si—TiB2 In-Situ Composites, Metall Mater Trans A, 40 (2009) 223-231. https://doi.org/10.1007/s11661-008-9696-x.
Leon-Patiño CA et al. Role of metal interlayers in the infiltration of metal-ceramic composites, Curr. Opin. Solid State Mater. Sci. 9 (2005) 211-218. https://doi.org/10.1016/j.cossms.2006.04.006.
Liu P et al. Characterization and evaluation of interface in SiCp/2024 Al composite, Trans. Nonferrous Met. Soc. China (English Ed. 25 (2015) 1410-1418. https://doi.org/10.1016/S1003-6326(15)63740-2.
Liu Y et al. Formation of transition layer and its effect on mechanical properties of AlCoCrFeNi high-entropy alloy/Al composites, J. Alloys Compd. 780 (2019) 558-564. https://doi.org/10.1016/j.jallcom.2018.11.364.
Liu Z et al. Effect of ultrasonic vibration on microstructural evolution of the reinforcements and degassing of in situ TiB2p/Al—12Si—4Cu composites. Journal of Materials Processing Technology, 2012, 212(2): 365-371.
Liu Z et al. Processing and tensile properties of A356 composites containing in situ small-sized Al3Ti particulates, Mater. Sci. Eng. A. 710 (2018) 392-399. https://doi.org/10.1016/j.msea.2017.11.005.
Lloyd DJ. Particle reinforced aluminium and magnesium matrix composites, Int. Mater. Rev. 39 (1994) 1-23. https://doi.org/10.1179/imr.1994.39.1.1.
Ma S et al. The in-situ formation of Al3Ti reinforcing particulates in an Al-7wt.%Si alloy and their effects on mechanical properties, J. Alloys Compd. 792 (2019) 365-374. https://doi.org/10.1016/j.jallcom.2019.04.064.
Nofar M et al. Fabrication of high wear resistant Al/Al3Ti metal matrix composite by in situ hot press method, Materials and Design, 30 (2009) 280-286.
Rao RN et al. Effect of matrix alloy and influence of SiC particle on the sliding wear characteristics of aluminium alloy composites, Mater. Des. 31 (2010) 1200-1207. https://doi.org/10.1016/j.matdes.2009.09.032.
Shi R et al. Controlling particle/metal interactions in metal matrix composites during solidification: the role of melt viscosity and cooling rate. Metallurgical and Materials Transactions A, 50A (2019), 3736-3747.
Suryanarayana C. Mechanical alloying and milling, Prog. Mater. Sci. 46 (2001) 1-184. https://doi.org/10.1016/S0079-6425(99)00010-9.
Wang X et al. In situ fabrication of Al3 Ti particle reinforced aluminium alloy metal-matrix composites, Mater. Sci. Eng. A. 364 (2004) 339-345. https://doi.org/10.1016/j.msea.2003.08.049.
Xu H et al. Degassing of molten aluminum A356 alloy using ultrasonic vibration, Mater. Lett. 58 (2004) 3669-3673.
Yuan Z et al. Microstructure and properties of high-entropy alloy reinforced aluminum matrix composites by spark plasma sintering, J. Alloys Compd. 806 (2019) 901-908. https://doi.org/10.1016/j.jallcom.2019.07.185.
Zaiemyekeh Z et al. Effect of strain rate on deformation behavior of aluminum matrix composites with Al2O3 nanoparticles, Mater. Sci. Eng. A. 753 (2019) 276-284. https://doi.org/10.1016/j.msea.2019.03.052.
International Search Report and Written Opinion mailed Feb. 23, 2023 in related International Application No. PCT/US22/50252 (9 pages).
Zhang et al. "Insight of High Entropy alloy particles reinforced 2219 Al matrix composites via the ultrasonic casting technology," Mat Charac. 2021, 182, 111548 (12 pages).

* cited by examiner

| Element | Atomic % |
|---|---|
| Al | 23.87 |
| Ti | 25.93 |
| V | 25.39 |
| Cr | 24.81 |

METAL MATRIX COMPOSITES AND METHODS OF MAKING AND USE THEREOF

CROSS-REFERENCE TO RELATED APPLICATIONS

This application claims the benefit of priority to U.S. Provisional Application No. 63/281,765, filed Nov. 22, 2021, which is hereby incorporated herein by reference in its entirety.

BACKGROUND

Metal matrix composites (MMCs) have attractive physical and mechanical properties, such as low density, high strength, high wear resistance, and good high-temperature performance, for aerospace, defense and automotive industries.

Traditionally, ceramic particles are used as the reinforcements in aluminum matrix composites. Although ceramic particles have advantages of high hardness, high elastic modulus, and good thermal stability, they generally have poor wettability with molten aluminum, which poses significant challenges to the manufacturing of aluminum matrix composites and negatively impacts their mechanical properties.

In order to overcome the poor wettability between ceramic particles and molten aluminum, powder-based processing methods have been used. However, the powder metallurgy methods suffer from various shortcomings (e.g., high cost, multiple steps, etc.) which hinder the wide adoption of powder metallurgy processes for the large scale production of aluminum matrix composites, and limit their commercial applications.

Improved metal matrix composites and methods of making thereof are needed. The compositions and methods discussed herein address these and other needs.

SUMMARY

In accordance with the purposes of the disclosed compositions and methods as embodied and broadly described herein, the disclosed subject matter relates to metal matrix composites and methods of making and use thereof.

For example, disclosed herein are methods of making a metal matrix composite comprising a metal matrix reinforced by a high entropy alloy. The methods can comprise mixing a first powder and a second powder to form a powder mixture, wherein the first powder comprises a plurality of particles comprising a metal and the second powder comprises a plurality of particles comprising a high entropy alloy. The methods can further comprise compacting the powder mixture to form a pellet. The methods further comprise adding the pellet to a molten metal, the molten metal comprising the metal in a molten state, thereby melting the pellet to form a molten mixture. The methods further comprise subjecting the molten mixture to an ultrasonic treatment, thereby forming an ultrasonic treated mixture. The methods further comprise casting the ultrasonic treated mixture to form the metal matrix composite.

In some examples, the powder mixture comprises the first powder and the second powder in a ratio of from 10:1 to 1:10 (weight:weight). In some examples, the powder mixture comprises the first powder and the second powder in a 1:1 ratio (wt:wt).

In some examples, the metal is a pure metal or an alloy comprising the metal. In some examples, the metal comprises a lightweight metal.

In some examples, the metal comprises aluminum, magnesium, silicon, zinc, titanium, copper, manganese, zirconium, boron, rare earth elements, or a combination thereof. In some examples, the metal comprises aluminum or magnesium.

In some examples, the metal comprises an alloy. In some examples, the metal comprises an aluminum alloy, such as 7075 alloy. In some examples, the metal comprises a magnesium alloy, such as AZ91 alloy.

In some examples, the metal comprises pure aluminum.

In some examples, the high entropy alloy is provided in an amount of from 1-30 wt. % relative to the final weight of the metal matrix composite. In some examples, the high entropy alloy is provided in amount of from 1-10 wt. %, 1-6 wt. %, 3-6 wt. %, or 2-4 wt. %.

In some examples, the high entropy alloy comprises AlCrTiV.

In some examples, the molten mixture is subjected to the ultrasonic treatment for an amount of time of from 1 second to 5 minutes. In some examples, the molten mixture is subjected to the ultrasonic treatment for 30 seconds.

In some examples, the ultrasonic treatment is applied by a device comprising an ultrasonic generator, a transducer, and a horn. In some examples, the horn at least partially submerged in the molten mixture to transmit the ultrasonic treatment.

In some examples, the ultrasonic treatment disperses the plurality of particles comprising the high entropy alloy substantially uniformly in the molten mixture.

In some examples, the method further comprises making the second powder. In some examples, the method further comprises making the first powder. In some examples, the method the method comprises ball milling.

In some examples, the method further comprises making the high entropy alloy.

In some examples, the method further comprises selecting the high entropy alloy to reinforce the metal matrix.

Also disclosed herein are methods of selecting a high entropy alloy to reinforce a metal matrix to form a metal matrix composite. In some examples, the high entropy alloy is selected based on its wettability and/or interfacial bonding with the metal matrix.

Also disclosed herein are metal matrix composites, for example made by any of the methods disclosed herein. In some examples, the metal matrix composite has a refined grain size relative to the metal matrix in the absence of the high entropy alloy. In some examples, the metal matrix composite has an improved mechanical property relative to the metal matrix in the absence of the high entropy alloy. In some examples, the metal matrix composite has an improved yield strength relative to the metal matrix in the absence of the high entropy alloy. In some examples, the yield strength of the metal matrix composite is greater than the metal matrix in the absence of the high entropy alloy by 10% or more, 30% or more, 50% or more, 60% or more, or 80% or more. In some examples, the metal matrix composite has an improved ultimate tensile strength relative to the metal matrix in the absence of the high entropy alloy. In some examples, the ultimate tensile strength of the metal matrix composite is greater than metal matrix in the absence of the high entropy alloy by 10% or more, 30% or more, 50% or more, or 80% or more. In some examples, the metal matrix composite has an improved elastic modulus relative to the metal matrix in the absence of the high entropy alloy.

Also disclosed herein are articles of manufacture comprising any of the metal matrix composites disclosed herein.

Also disclosed herein are methods of use of any of the metal matrix composites disclosed herein and/or any of the articles of manufacture disclosed herein. In some examples, the method comprises using the metal matrix composite or the article in an automotive or aerospace application. In some examples, the method comprises using the metal matrix composite or the article in a transportation application, a defense application, or a consumer product.

Additional advantages of the disclosed compositions and methods will be set forth in part in the description which follows, and in part will be obvious from the description. The advantages of the disclosed compositions and methods will be realized and attained by means of the elements and combinations particularly pointed out in the appended claims. It is to be understood that both the foregoing general description and the following detailed description are exemplary and explanatory only and are not restrictive of the disclosed compositions and methods, as claimed.

The details of one or more embodiments of the invention are set forth in the accompanying drawings and the description below. Other features, objects, and advantages of the invention will be apparent from the description and drawings, and from the claims.

BRIEF DESCRIPTION OF THE FIGURES

The accompanying figures, which are incorporated in and constitute a part of this specification, illustrate several aspects of the disclosure, and together with the description, serve to explain the principles of the disclosure.

DETAILED DESCRIPTION

Figure 1:
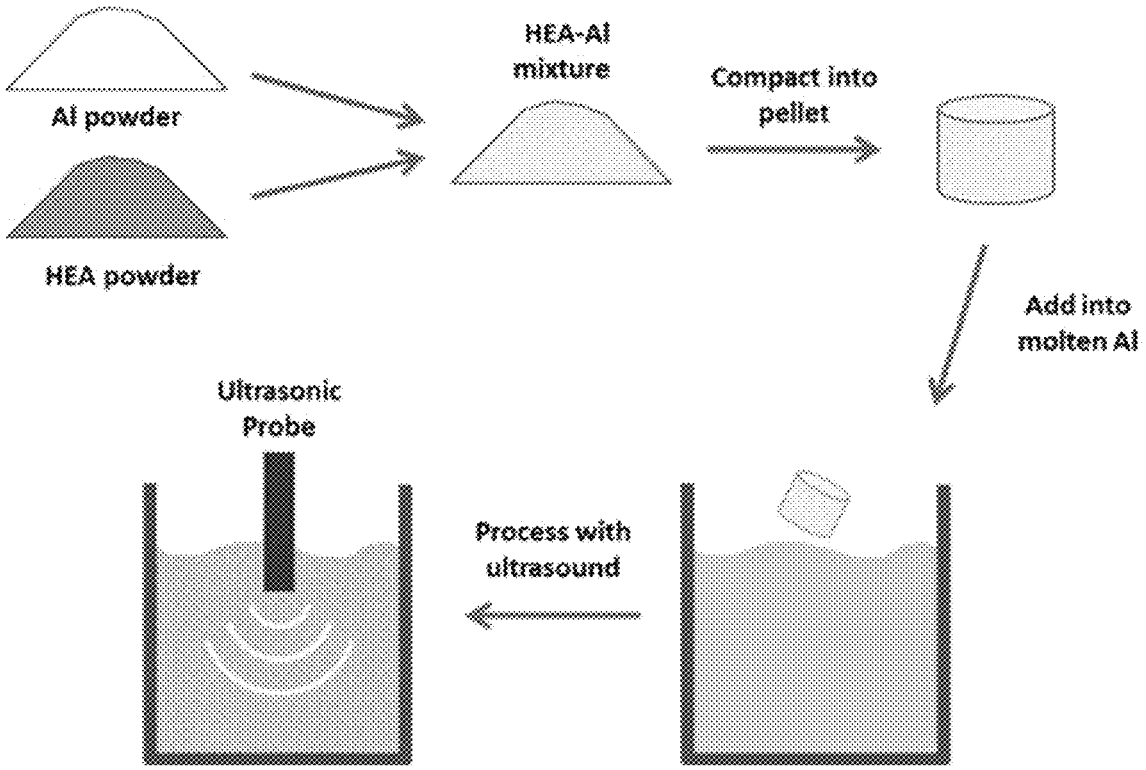
FIG. 1. Illustration of the process of adding HEA particles into molten aluminum.

The compositions and methods described herein may be understood more readily by reference to the following detailed description of specific aspects of the disclosed subject matter and the Examples included therein.

Before the present compositions and methods are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

In this specification and in the claims that follow, reference will be made to a number of terms, which shall be defined to have the following meanings.

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such components, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

"Exemplary" means "an example of" and is not intended to convey an indication of a preferred or ideal embodiment. "Such as" is not used in a restrictive sense, but for explanatory purposes.

Values can be expressed herein as an "average" value. "Average" generally refers to the statistical mean value.

By "substantially" is meant within 5%, e.g., within 4%, 3%, 2%, or 1%.

It is understood that throughout this specification the identifiers "first" and "second" are used solely to aid in distinguishing the various components and steps of the disclosed subject matter. The identifiers "first" and "second" are not intended to imply any particular order, amount, preference, or importance to the components or steps modified by these terms.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is based on the total weight of the formulation or composition in which the component is included.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, "molecular weight" refers to number average molecular weight as measured by $^{1}H$ NMR spectroscopy, unless indicated otherwise.

Disclosed herein are metal matrix composites and methods of making and use thereof.

For example, disclosed herein are methods of making a metal matrix composite comprising a metal matrix reinforced by a high entropy alloy, the method comprising: mixing a first powder and a second powder to form a powder mixture, wherein the first powder comprises a plurality of particles comprising a metal and the second powder comprises a plurality of particles comprising a high entropy alloy; compacting the powder mixture to form a pellet; adding the pellet to a molten metal, the molten metal comprising the metal in a molten state, thereby melting the pellet to form a molten mixture; subjecting the molten mixture to an ultrasonic treatment, thereby forming an ultrasonic treated mixture; and casting the ultrasonic treated mixture to form the metal matrix composite.

The powder mixture can, for example, comprise the first powder and the second powder in a ratio of 10:1 (weight:weight) or less (e.g., 9:1 or less, 8:1 or less, 7:1 or less, 6:1 or less, 5:1 or less, 4.5:1 or less, 4:1 or less, 3.5:1 or less, 3:1 or less, 2.5:1 or less, 2:1 or less, 1.75:1 or less, 1.5:1 or less, 1.25:1 or less, 1:1 or less, 1:1.25 or less, 1:1.5 or less, 1:1.75 or less, 1:2 or less, 1:2.5 or less, 1:3 or less, 1:3.5 or less, 1:4 or less, 1:4.5 or less, 1:5 or less, 1:6 or less, 1:7 or less, 1:8 or less, or 1:9 or less). In some examples, the powder mixture can comprise the first powder and the second powder in a ratio of 1:10 (wt:wt) or more (e.g., 1:9 or more, 1:8 or more, 1:7 or more, 1:6 or more, 1:5 or more, 1:4.5 or more, 1:4 or more, 1:3.5 or more, 1:3 or more, 1:2.5 or more, 1:2 or more, 1:1.75 or more, 1:1.5 or more, 1:1.25 or more, 1:1 or more, 1.25:1 or more, 1.5:1 or more, 1.75:1 or more, 2:1 or more, 2.5:1 or more, 3:1 or more, 3.5:1 or more, 4:1 or more, 4.5:1 or more, 5:1 or more, 6:1 or more, 7:1 or more, 8:1 or more, or 9:1 or more). The ratio of the first powder to the second powder in the powder mixture can range from any of the minimum values described above to any of the maximum values described above. For example, the powder mixture can comprise the first powder and the second powder in a ratio of from 10:1 to 1:10 (weight:weight) (e.g., from 10:1 to 1:1, from 1:1 to 1:10, from 10:1 to 5:1, from 5:1 to 1:1, from 1:1 to 1:5, from 1:5 to 1:10, from 9:1 to 1:10, from 10:1 to 1:9, from 9:1 to 1:9, from 5:1 to 1:5, or from 2:1 to 1:2). In some examples, the powder mixture comprises the first powder and the second powder in a 1:1 ratio (wt:wt).

The metal can, for example, be a pure metal or an alloy comprising the metal. In some examples, the metal comprises a lightweight metal. In some examples, the metal comprises aluminum, magnesium, silicon, zinc, titanium, copper, manganese, zirconium, boron, rare earth elements, or a combination thereof. In some examples, the metal comprises aluminum or magnesium. In some examples, the metal is an alloy comprising the metal, such as an aluminum alloy (e.g., a 7075 alloy) or a magnesium alloy (e.g., an AZ91 alloy). In some examples, the metal is pure aluminum.

The high entropy alloy can comprise any suitable material, such as those known in the art. High Entropy Alloys is a class of multiple-principal-element alloys stabilized by large configurational entropy. Unlike conventional alloys based on a single principal element with relatively small amounts of alloying elements, High Entropy Alloys typically have four, five or even more principal elements, all in relatively high amounts. High Entropy Alloys can offer exceptional mechanical, chemical, and magnetic properties at room and elevated temperatures. Primarily due to the high entropy effect, the microstructure of a High Entropy Alloy usually exhibits a single solid solution phase having a body-centered cubic (BCC) structure, a face-centered cubic (FCC) structure, a hexagonal closed-packed (HCP), or a mixture of two or more thereof. Often, there is a predominant solution phase (e.g., with a structure as described above), with a minor amount of one or more intermetallics.

For example, the high entropy alloy can comprise any of the high entropy alloys described by Huang et al. J. Mater. Sci. 2019, 54, 2271-2277 or U.S. Pat. No. 11,168,385, both of which are incorporated herein in for their description of high entropy alloys.

In some examples, the high entropy alloy can comprise a CoCrFeMnNi, TaNbHfZrTi, WNbMoTaV, AlCrTiV, or a combination thereof. In some examples, the high entropy alloy can comprise AlCrTiV, such as those described by Huang et al. J. Mater. Sci. 2019, 54, 2271-2277 or U.S. Pat. No. 11,168,385.

The high entropy alloy can, for example, be provided in an amount of 1 wt. % or more relative to the final weight of the metal matrix composite (e.g., 1.5 wt. % or more, 2 wt. % or more, 2.5 wt. % or more, 3 wt. % or more, 3.5 wt. % or more, 4 wt. % or more, 4.5 wt. % or more, 5 wt. % or more, 5.5 wt. % or more, 6 wt. % or more, 6.5 wt. % or more, 7 wt. % or more, 7.5 wt. % or more, 8 wt. % or more, 8.5 wt. % or more, 9 wt. % or more, 9.5 wt. % or more, 10 wt. % or more, 11 wt. % or more, 12 wt. % or more, 13 wt. % or more, 14 wt. % or more, 15 wt. % or more, 16 wt. % or more, 17 wt. % or more, 18 wt. % or more, 19 wt. % or more, 20 wt. % or more, 21 wt. % or more, 22 wt. % or more, 23 wt. % or more, 24 wt. % or more, 25 wt. % or more, 26 wt. % or more, 27 wt. % or more, 28 wt. % or more, or 29 wt. % or more).

In some examples, the high entropy alloy can be provided in an amount of 30 wt. % or less relative to the final weight of the metal matrix composite (e.g., 29 wt. % or less, 28 wt. % or less, 27 wt. % or less, 26 wt. % or less, 25 wt. % or less, 24 wt. % or less, 23 wt. % or less, 22 wt. % or less, 21 wt. % or less, 20 wt. % or less, 19 wt. % or less, 18 wt. % or less, 17 wt. % or less, 16 wt. % or less, 15 wt. % or less, 14 wt. % or less, 13 wt. % or less, 12 wt. % or less, 11 wt. % or less, 10 wt. % or less, 9.5 wt. % or less, 9 wt. % or less, 8.5 wt. % or less, 8 wt. % or less, 7.5 wt. % or less, 7 wt. % or less, 6.5 wt. % or less, 6 wt. % or less, 5.5 wt. % or less, 5 wt. % or less, 4.5 wt. % or less, 4 wt. % or less, 3.5 wt. % or less, 3 wt. % or less, 2.5 wt. % or less, 2 wt. % or less, or 1.5 wt. % or less).

The amount of high entropy alloy can range from any of the minimum values described above to any of the maximum values described above. For example, the high entropy alloy can be provided in an amount of from 1-30 wt. % relative to the final weight of the metal matrix composite (e.g., from 1 wt. % to 15 wt. %, from 15 wt. % to 30 wt. %, from 1 wt. % to 10 wt. %, from 10 wt. % to 20 wt. %, from 20 wt. % to 30 wt. %, from 2 wt. % to 30 wt. %, from 1 wt. % to 29 wt. %, from 2 wt. % to 29 wt. %, from 1 wt. % to 25 wt. %, from 1 wt. % to 20 wt. %, from 1 wt. % to 9 wt. %, from 1 wt. % to 6 wt. %, from 3 wt. % to 6 wt. %, or from 2 wt. % to 4 wt. %).

After adding the pellet to the molten metal, the method can comprise holding the molten metal with the pellet added for an amount of time sufficient to ensure that the pellet is completely melted to form the molten mixture before subjecting the molten mixture to the ultrasonic treatment. For example, the method can comprise holding the molten metal with the pellet added for an amount of time of 5 minutes or more (e.g., 6 minutes or more, 7 minutes or more, 8 minutes or more, 9 minutes or more, 10 minutes or more, 11 minutes or more, 12 minutes or more, 13 minutes or more, or 14 minutes or more). In some examples, the method can comprise holding the molten metal with the pellet added for an amount of time of 15 minutes or less (e.g., 14 minutes or less, 13 minutes or less, 12 minutes or less, 11 minutes or less, 10 minutes or less, 9 minutes or less, 8 minutes or less, 7 minutes or less, or 6 minutes or less). The amount of time can range from any of the minimum values described above to any of the maximum values described above. For example, the method can comprise holding the molten metal with the pellet added for an amount of time of from 5 minutes to 15 minutes (e.g., from 5 minutes to 10 minutes, from 10 minutes to 15 minutes, from 5 minutes to 7 minutes, from 7 minutes to 9 minutes, from 9 minutes to 11 minutes, from 11 minutes to 13 minutes, from 13 minutes to 15 minutes, from 6 minutes to 15 minutes, from 5 minutes to 14 minutes, or from 6 minutes to 14 minutes). The amount of time can be selected in view of a variety of factors, such as, for example, the temperature of the molten metal, the amount of high entropy alloy to the final weight of the metal matrix composite, the identity of the molten metal, the composition of the pellet, or a combination thereof.

The molten mixture can, for example, be subjected to the ultrasonic treatment for an amount of time of 1 second or more (e.g., 5 seconds or more, 10 seconds or more, 15 seconds or more, 20 seconds or more, 25 seconds or more, 30 seconds or more, 35 seconds or more, 40 seconds or more, 45 seconds or more, 50 seconds or more, 55 seconds or more, 1 minute or more, 1.5 minutes or more, 2 minutes or more, 2.5 minutes or more, 3 minutes or more, 3.5 minutes or more, 4 minutes or more, or 4.5 minutes or more). In some examples, the molten mixture can be subjected to the ultrasonic treatment for an amount of time of 5 minutes or less (e.g., 4.5 minutes or less, 4 minutes or less, 3.5 minutes or less, 3 minutes or less, 2.5 minutes or less, 2 minutes or less, 1.5 minutes or less, 1 minute or less, 55 seconds or less, 50 seconds or less, 45 seconds or less, 40 seconds or less, 35 seconds or less, 30 seconds or less, 25 seconds or less, 20 seconds or less, 15 seconds or less, 10 seconds or less, or 5 seconds or less). The amount of time that the molten mixture is subjected to the ultrasonic treatment can range from any of the minimum values described above to any of the maximum values described above. For example, the molten mixture can be subjected to the ultrasonic treatment for an amount of time of from 1 second to 5 minutes (e.g., from 1 second to 2.5 minutes, from 2.5 minutes to 5 minutes, from 1 second to 10 seconds, from 10 seconds to 1 minute, from 1 minute to 5 minutes, from 1 second to 4.5 minutes, from 5 seconds to 5 minutes, from 5 seconds to 4.5 minutes, from 1 second to 4 minutes, from 1 second to 2 minutes, from 1 second to 1 minute, or from 20 seconds to 40 seconds). In some examples, the molten mixture is subjected to the ultrasonic treatment for 30 seconds.

In some examples, the ultrasonic treatment is applied by a device comprising an ultrasonic generator, a transducer, and a horn. The horn can, for example, be at least partially submerged in the molten mixture to transmit the ultrasonic treatment.

In some examples, the ultrasonic treatment can disperse the plurality of particles comprising the high entropy alloy substantially uniformly in the molten mixture.

In some examples, the methods can further comprise making the first powder and/or the second powder, for example by grinding, milling (e.g., air-attrition milling (jet milling) or ball milling), and the like. In some examples, the methods can further comprise making the second powder by ball milling.

In some examples, the methods can further comprise making the high entropy alloy.

In some examples, the methods can further comprise selecting the high entropy alloy to reinforce the metal matrix.

Also disclosed herein are methods of selecting a high entropy alloy to reinforce a metal matrix to form a metal matrix composite.

The high entropy alloy can, for example, be selected based on its wettability and/or interfacial bonding with the metal matrix.

Also disclosed herein are metal matrix composites made by any of the methods herein.

In some examples, the metal matrix composite can have a refined grain size relative to the metal matrix in the absence of the high entropy alloy.

In some examples, the metal matrix composite can have an improved mechanical property relative to the metal matrix in the absence of the high entropy alloy, such as an improved yield strength, an improved ultimate tensile strength, an improved elastic modulus, or a combination thereof.

In some examples, the metal matrix composite can have an improved yield strength relative to the metal matrix in the absence of the high entropy alloy. For example, the yield strength of the metal matrix composite is greater than the metal matrix in the absence of the high entropy alloy by 10% or more (e.g., 15% or more, 20% or more, 25% or more, 30% or more, 35% or more, 40% or more, 45% or more, 50% or more, 55% or more, 60% or more, 65% or more, 70% or more, 75% or more, 80% or more, 85% or more, 90% or more, 95% or more, or 100% or more).

In some examples, the metal matrix composite can have an improved ultimate tensile strength relative to the metal matrix in the absence of the high entropy alloy. For example, the ultimate tensile strength of the metal matrix composite is greater than metal matrix in the absence of the high entropy alloy by 10% or more (e.g., 15% or more, 20% or more, 25% or more, 30% or more, 35% or more, 40% or more, 45% or more, 50% or more, 55% or more, 60% or more, 65% or more, 70% or more, 75% or more, 80% or more, 85% or more, 90% or more, 95% or more, or 100% or more).

In some examples, the metal matrix composite can have an improved elastic modulus relative to the metal matrix in the absence of the high entropy alloy.

Also disclosed herein are articles of manufacture comprising any of the metal matrix composites disclosed herein.

Also disclosed herein are methods of use of any of the metal matrix composites or the articles of manufacture disclosed herein. The method can, for example, comprise using the metal matrix composite or the article in an automotive or aerospace application. In some examples, the method comprises using the metal matrix composite or the article in a transportation application, a defense application, or a consumer product.

A number of embodiments of the invention have been described. Nevertheless, it will be understood that various modifications may be made without departing from the spirit and scope of the invention. Accordingly, other embodiments are within the scope of the following claims.

The examples below are intended to further illustrate certain aspects of the systems and methods described herein, and are not intended to limit the scope of the claims.

EXAMPLES

The following examples are set forth below to illustrate the methods and results according to the disclosed subject matter. These examples are not intended to be inclusive of all aspects of the subject matter disclosed herein, but rather to illustrate representative methods and results. These examples are not intended to exclude equivalents and variations of the present invention which are apparent to one skilled in the art.

Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of measurement conditions, e.g., component concentrations, temperatures, pressures and other measurement ranges and conditions that can be used to optimize the described process.

Example 1—on the Interactions Between Molten Aluminum and High Entropy Alloy Particles During Aluminum Matrix Composite Processing Abstract. The feasibility of adding AlCrTiV high entropy alloy (HEA) particles to molten aluminum to make metal matrix composites was studied. Equiatomic AlCrTiV HEA particles, produced by a solid state reduction process, were dispersed into pure aluminum and 7075 alloy (Al-5.8Zn-2.3Mg-1.4Cu, all weight %) melt and by an ultrasonic dispenser. It was found that the AlCrTiV particles reacted with molten aluminum, leading to the formation of $Al_{45}(Cr,V)_7$ and $Al_3Ti$ intermetallic phases in the aluminum matrix composites. Although the AlCrTiV HEA particles did not survive in molten aluminum during composite processing, the final composite materials showed significantly improved mechanical properties, due to grain refinement and dispersion strengthening. The research suggests that the interactions between matrix aluminum alloys and the HEA particles are key in controlling the final microstructure and properties of the composites.

Introduction. Aluminum matrix composites have promising physical and mechanical properties, such as low density, high strength (Guo et al. *Mater. Charact.* 2020, 170, 110666), high wear resistance (Kumar et al. *Metall Mater Trans A,* 2009, 40, 223-231; Rao et al. *Mater. Des.* 2010, 31, 1200-1207), and excellent high-temperature performance (Ji et al. *Mater. Sci. Eng. A.* 2009, 506, 58-62; Gong et al. *Mater. Sci. Eng. A.* 2020, 770, 138551), which are attractive to the aerospace and automotive industries. Traditionally, ceramic particles are used as the reinforcement phase in aluminum matrix composites (Lloyd, *Int. Mater. Rev.* 1994, 39,1-23). The common reinforcement particles include SiC (Rao et al. *Mater. Des.* 2010, 31, 1200-1207), $SiO_2$ (Issa et al. *Ceram. Int.* 2017, 43, 14582-14592), WC (Ji et al. *Mater. Sci. Eng. A.* 2009, 506, 58-62), $Al_2O_3$ (Zaiemyekeh et al. *Mater. Sci. Eng. A.* 2019, 753, 276-284), etc. Although ceramic particles have advantages of high hardness, high elastic modulus, and good thermal stability, they generally have poor wettability with molten aluminum, which poses significant challenges to the manufacturing of aluminum matrix composites and negatively impacts their mechanical properties.

The poor wettability makes it difficult to add and uniformly disperse ceramic particles in molten aluminum, thus, ceramic particles tend to agglomerate in the solidification microstructure. The poor wettability between the externally added ceramic particles and aluminum matrix also leads to weak bonding between them. The interface can easily act as nucleation sites for cracks during deformation (Guo et al. *Scr. Mater.* 2016, 114, 56-59; Liu et al. *Trans. Nonferrous Met. Soc. China* (English Ed.) 2015, 25, 1410-1418). Therefore, most aluminum matrix composites achieve significant improvements in Young's modulus and monotonic strength, but at the expense of ductility and fatigue properties.

In order to overcome the poor wettability between ceramic particles and molten aluminum, powder-based processing methods (similar to conventional powder metallurgy processing) are the most widely adopted methods to synthesize bulk composite materials (Lloyd, *Int. Mater. Rev.* 1994, 39, 1-23). This type of process usually involves blending reinforcement particles with alloy powder, powder compacting, and sintering. There are many techniques developed for sintering powder-based aluminum matrix composites, including conventional sintering, microwave sintering, and spark plasma sintering (SPS) (Ghasali et al. *J. Alloys Compd.* 2016, 688, 527-533). However, the powder metallurgy method is financially unfavored due to high powder production cost and extra process steps. The bulk parts after conventional or microwave sintering usually contain a large number of pores and require subsequent thermomechanical processing, such as hot isostatic pressing (HIP), rolling or extrusion to remove/reduce porosity (Issa et al. *Ceram. Int.* 2017, 43, 14582-14592). Although the bulk parts prepared by SPS are considered fully condensed (Ghasali et al. *J. Alloys Compd.* 2016, 688, 527-533), the technique can only produce parts of simple geometry, and requires thermomechanical processing and machining for the final parts. All these shortcomings hinder the wide adoption of powder metallurgy processes for the large scale production of aluminum matrix composites, and limit their commercial applications. On the other hand, liquid state processing, i.e., mixing and casting method, is more desirable for mass production of near shape parts, and is more economically attractive for commercial applications (Bhoi et al. *J. Compos. Mater.* 2020, 54, 813-833).

In order to improve the wettability between reinforcement particles and matrix alloys during solidification processing of metal matrix composites, researchers have attempted to apply metallic coatings on ceramic particles, which achieved some favorable results (Leon-Patiño et al. *Curr. Opin. Solid State Mater. Sci.* 2005, 9, 211-218). The metallic interlayer promotes certain reactions between the coating materials and the aluminum matrix alloy, which forms an intermetallic layer and improves wettability (Drew et al. *Composites Part A: Applied Science and Manufacturing,* 2002, 33, 1429-1432). Common metals that are used for such coatings are Ni and Cu (Chung et al. *Mater. Res. Bull.* 1996, 31, 1437-1447; Asthana et al. *Key Eng. Mater.* 1993, 80, 47-62).

Similarly, there has been increasing interest in directly using metallic materials as reinforcement in aluminum matrix composites. Researchers have used pure titanium particles (Guo et al. *Mater. Charact.* 2020, 170, 110666), and metallic glass particles (Guan et al. *Mater. Sci. Eng. A.* 2020, 771, 138630) as reinforcement in aluminum matrix composites.

Recently, high entropy alloy (HEA) particles (Liu et al. *J. Alloys Compd.* 2019, 780, 558-564; Yuan et al. *J. Alloys Compd.* 2019, 806, 901-908) have also been tried as reinforcement in aluminum matrix composites. These HEA particles all formed an intermetallic phase transition layer. It was reported that an aluminum composite reinforced by AlCoCrFeNi HEA particles retained the ductility to the most extent, compared to the base aluminum alloy without reinforcement (Liu et al. *J. Alloys Compd.* 2019, 780, 558-564). So far, almost all HEA particle reinforced composites were fabricated in the powder-based process (Liu et al. *J. Alloys Compd.* 2019, 780, 558-564; Yuan et al. *J. Alloys Compd.* 2019, 806, 901-908; Chen et al. *J. Alloys Compd.* 2015, 649, 630-634). The behavior of HEA particles in molten aluminum has not been studied. Therefore, it is very important to understand the interactions between HEA particles and molten aluminum, which is valuable for designing castable aluminum matrix composites with HEA additions.

AlCrTiV HEA, with an ordered structure, provides high hardness and high modulus (Huang et al. *J. Mater. Sci.* 2019, 54, 2271-2277). Therefore, equiatomic AlCrTiV HEA particles can be potentially used as a good reinforcement phase in aluminum matrix composites. In this study, the feasibility of using AlCrTiV particles as reinforcement in aluminum alloys was studied. Equiatomic AlCrTiV HEA particles were added into molten aluminum to study the interactions between particles and molten aluminum and the resulting materials. Equiatomic AlCrTiV HEA particles were successfully produced using a high energy ball milling via a solid state reduction method, and were dispersed in molten aluminum using an ultrasonic assisted casting process. The mechanical properties of the composite materials of pure aluminum and a high strength aluminum alloy 7075 (Al-5.8Zn-2.3Mg-1.4Cu, all weight %) with particle additions were examined Specific attention was paid to the interactions between molten aluminum and HEA particles, since they are important in controlling the interfacial strength and the final microstructure of the aluminum matrix composites.

Experimental Procedures

Powder preparation. Solid-state reduction was used to produce HEA powder as reinforcement for additions to molten aluminum. Firstly, ingots of equiatomic AlCrTiV composition were synthesized using an arc melter, and then broken down into small pieces and fed into a hardened steel milling jar in a Retsch high energy ball mill Emax to produce HEA powder, with a spin rate of 600 rpm and hardened steel mill balls of 1 cm diameter. N-dodecane was used as processing control agent (PCA) to prevent excessive cold welding and bonding between particles and milling balls. More importantly, the processing control agent will coat the surface of powder particles to prevent the agglomeration of powder particles, which is beneficial for size reduction (Suryanarayana. *Prog. Mater. Sci.* 2001, 46, 1-184). Ball milling was conducted under protective atmosphere of argon gas, and the milling jar was purged with argon gas for 3 minutes. The broken pieces were milled up to 40 hours, and the samples were taken out for characterization every 20 hours. In order to avoid overheating, ball milling was paused for 5 minutes after 15 minutes continuous run. For the solid-state reduction process, scanning electron microscopy (SEM) was used to determine the size and morphology of particles, and X-ray diffraction was used to assess phase transformation during milling.

Composite sample preparation. The bulk composite material samples were prepared via a melting and casting process as shown in FIG. 1.

Commercially pure aluminum and 7075 alloy were chosen as the base alloys in this study. 7075 is a high strength wrought alloy with a nominal composition of Al-5.8Zn-2.3Mg-1.4Cu (all in weight %). AlCrTiV powder manufactured through solid state reduction method was used as the reinforcement. The commercially pure aluminum and 7075 ingots were melted in a graphite crucible using a lab-scale induction furnace, equipped with a quartz tube chamber and rotary vacuum pump, which is capable of melting materials under vacuum or protective environment. After the ingot was completely melted, the oxide layer on the top of molten aluminum was skimmed before AlCrTiV powder was added.

In order to prevent excessive oxidation during addition, AlCrTiV powder was mixed with pure aluminum powder in a ratio of 1:1 using a ball mill. The powder mixture was compressed to 50 MPa into cylindrical bulk to reduce exposure to air. After adding the compressed powder bulk into molten aluminum, degassing was performed by vacuuming the quartz tube down to less than $3\times10^{-1}$ Torr. The purpose of degassing is to remove the hydrogen dissolved in the molten aluminum, which is detrimental to the mechanical properties of cast aluminum alloys (Xu et al. *Mater. Lett.* 2004, 58, 3669-3673). The molten aluminum was kept under vacuum for about 10 minutes, while the melt temperature was kept at around 750° C. Since Zn would evaporate from the molten aluminum under vacuum, for 7075 alloy and corresponding composite, the vacuum degassing process was not applied. Instead, the melt was kept under the protection of $SF_6$+$CO_2$ gas mixture.

After an ultrasonic treatment for 30 seconds, molten aluminum was poured into a steel mold to make castings of 100 mm×10 mm×5 mm. The steel mold was preheated to 200° C. before casting in an oven. The referential materials, Al and 7075, are also prepared using the same process as the corresponding MMCs.

An ultrasonic dispenser device comprising an ultrasonic generator, a transducer, and a horn to transmit ultrasonic vibration into aluminum melt. The transducer is capable of converting up to 760 W of electric energy at a resonant frequency of 20 kHz. In this process, ultrasound is conveyed to the aluminum melt by submerging a 1-inch diameter cylindrical horn made of a titanium alloy under the molten aluminum surface.

Microstructure characterization and mechanical testing. Thin foils for transmission electron microscopy (TEM) and scanning transmission electron microscopy (STEM) characterization were fabricated using a FEI Helios focused ion beam system. Conventional bright field/dark field TEM imaging and electron diffraction study were carried out using a FEI Tecnai F20 S/TEM microscope operating at 200 keV. Atomic resolution high-angle annular dark-field (HAADF) STEM imaging was conducted in a probe corrected Thermo Scientific Themis ZS/TEM microscope operating at 300 keV.

Dog-bone shaped tensile specimens were machined from the center of as-cast plates, with a parallel length of 32 mm, a gauge length of 25 mm, and a cross section of 6 mm×5 mm Tensile testing was carried out on a MTS Criterion Electromechanical Universal Test System at room temperature, with a constant crosshead speed of 0.01 mm/s.

Results and Discussion

Figure 2:
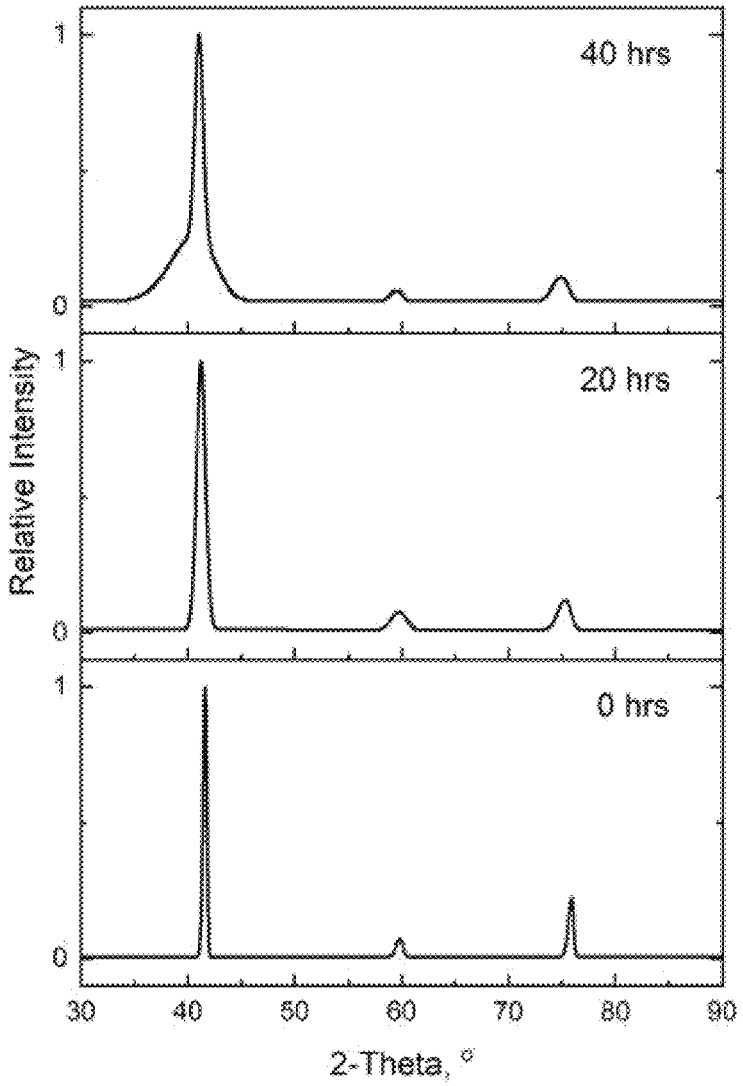
FIG. 2. XRD patterns of solid-state reduced AlCrTiV powder processed with different milling times, compared with XRD pattern of as-cast ingot.
Figure 3A:
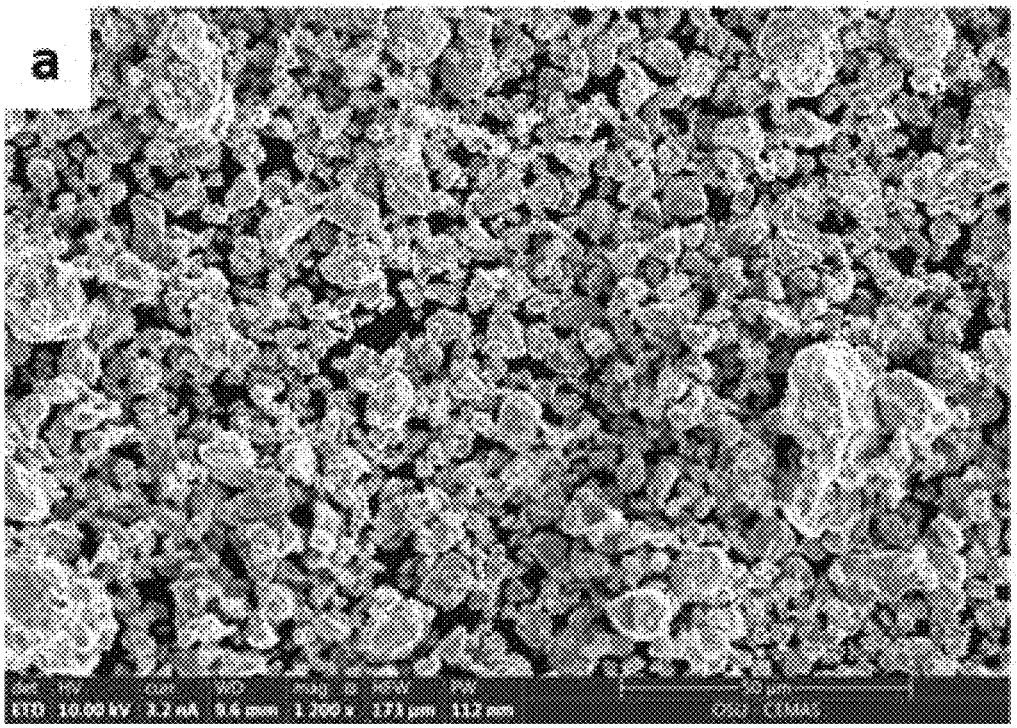
FIG. 3A. SEM micrograph showing the morphology of solid-state reduced HEA powders after a milling time of 20 hours.
Figure 3B:
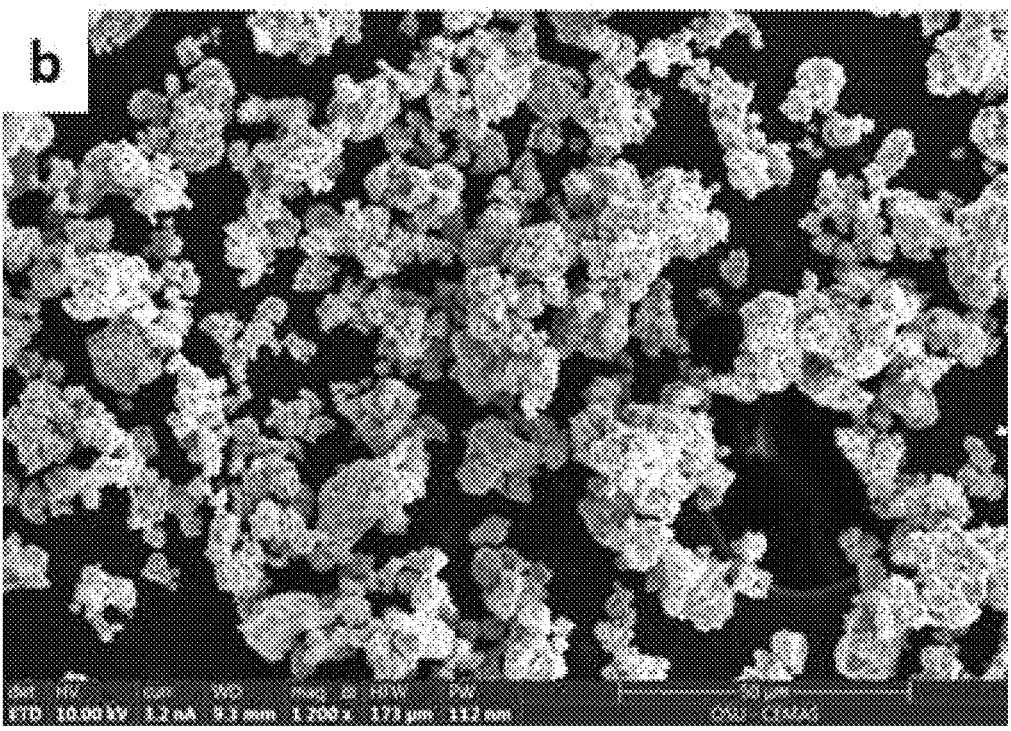
FIG. 3B. SEM micrograph showing the morphology of solid-state reduced HEA powders after a milling time of 40 hours.
Figure 4:
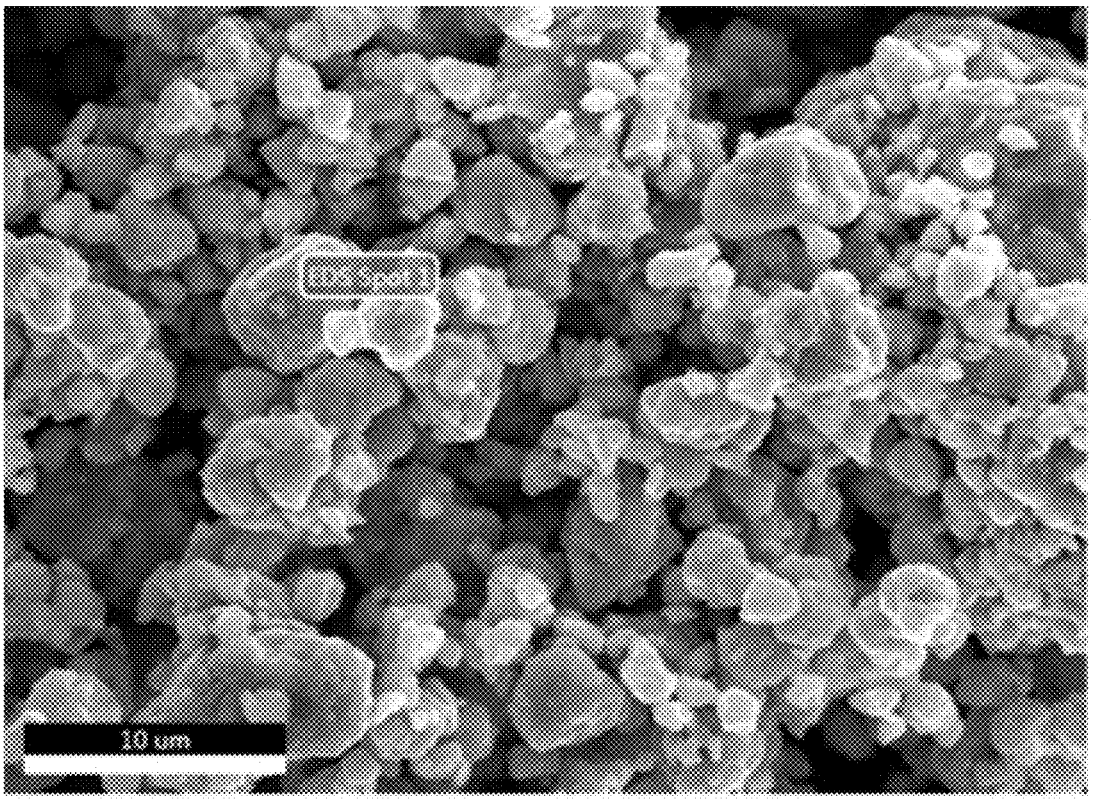
FIG. 4. EDS analysis on HEA particles after solid-state reduction for 40 hours.

Characterization on AlCrTiV powder. FIG. 2 illustrates the effects of milling time on the XRD patterns of the HEA powder produced through solid-state reduction. As milling time increases, the diffraction peaks become wider, due to the increasing micro-strain induced by plastic deformation and the decreasing crystallite size. After milling, the 20- and 40-hour powders maintained the same single-phase body centered cubic (BCC) crystal structure as the as-cast HEA ingot, with no new peaks and no absent peaks. The morphology and EDS analysis results of the solid-state reduced particles are shown in FIG. 3A-FIG. 3B and FIG. 4, respectively. The particle size is fairly uniform, with the average reduced from less than 10 μm in the 20-hour sample to less than 5 μm in the 40-hour sample. Because the particles were produced by pulverizing pre-alloyed AlCrTiV HEA with single BCC phase, the chemistry of each particle is expected to be the same as the chemistry of bulk material, as shown in FIG. 4.

Figure 5A:
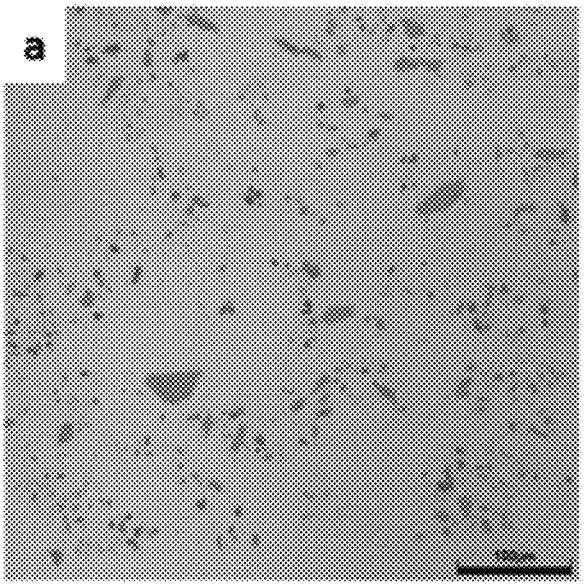
FIG. 5A. Optical micrograph of pure aluminum with 3 wt. % HEA particle addition.
Figure 5B:
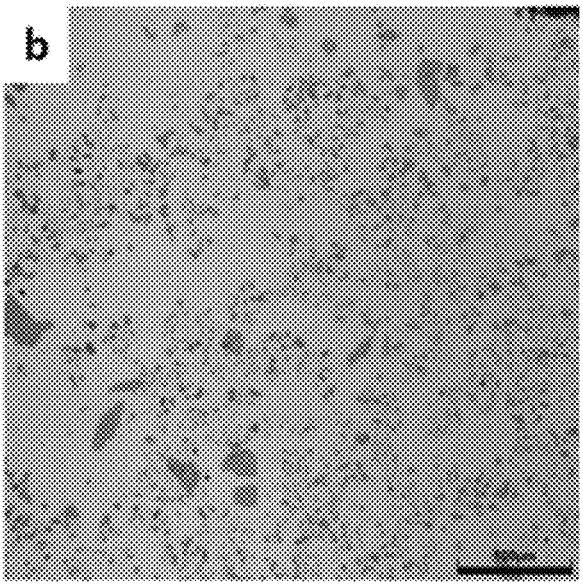
FIG. 5B. Optical micrograph of pure aluminum with 6 wt. % HEA particle addition.
Figure 5C:
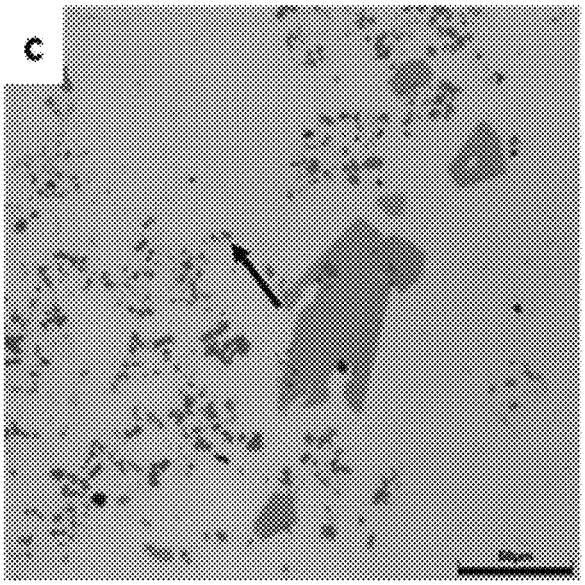
FIG. 5C. Optical micrographs of pure aluminum with 6 wt. % HEA particle addition sample at a higher magnification.
Figure 6A:
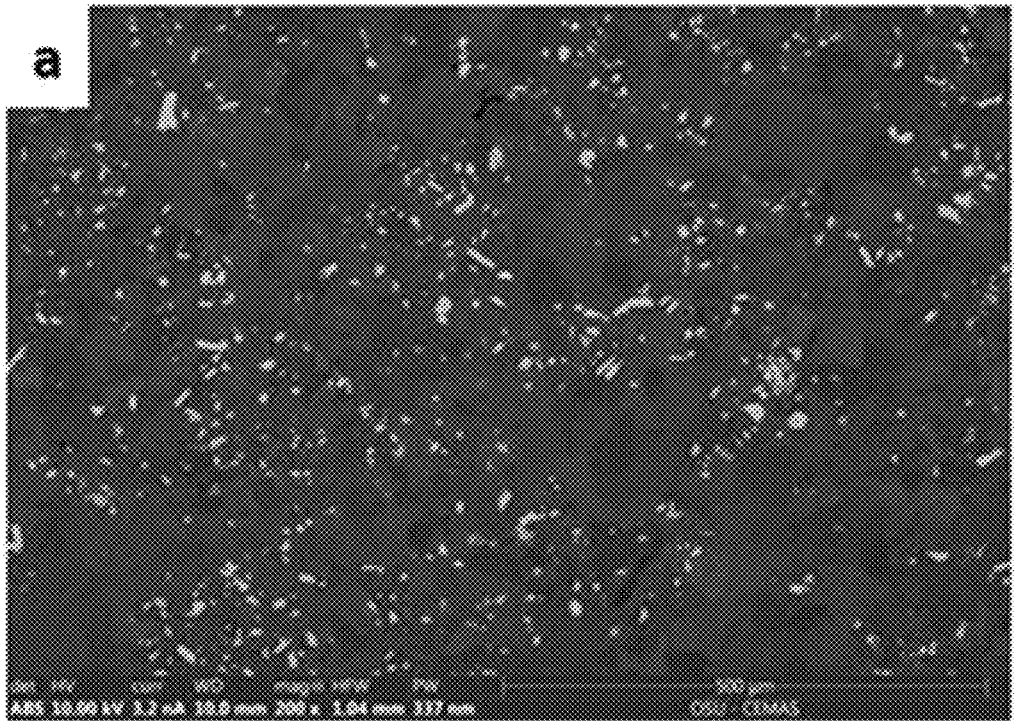
FIG. 6A. Backscattered electron image of Al with 3 wt. % HEA particle addition.
Figure 6B:
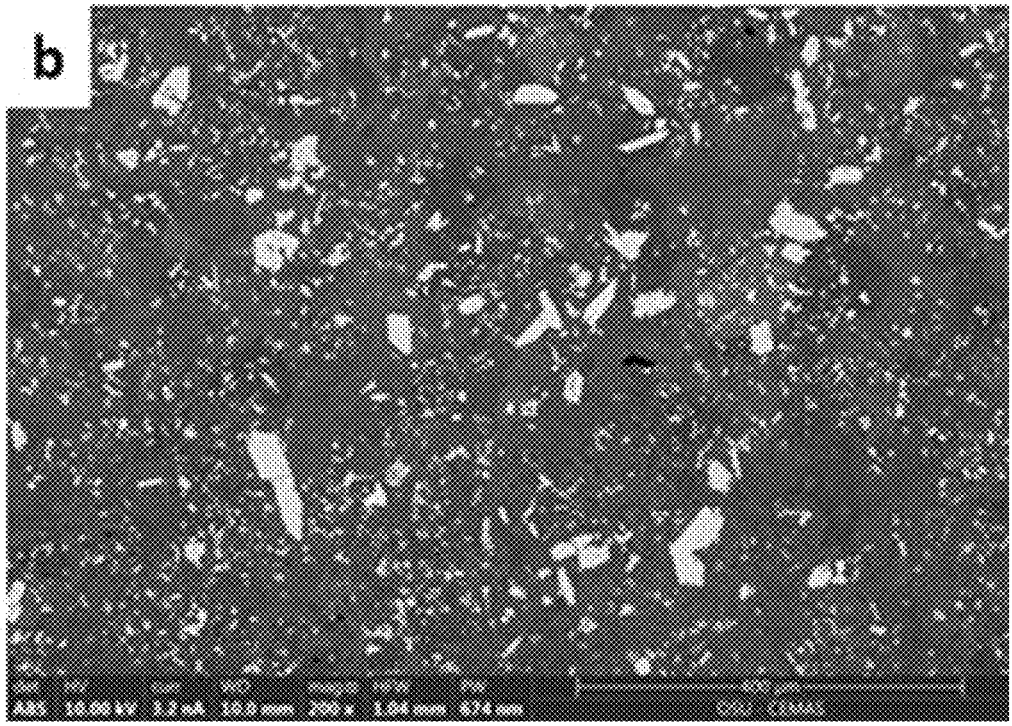
FIG. 6B. Backscattered electron image of Al with 6 wt. % HEA particle addition.

Characterization on as-cast composite materials. FIG. 5A-FIG. 5C shows optical micrographs of pure aluminum samples with 3 wt. % and 6 wt. % HEA particle additions. Both as-cast samples demonstrated uniform distribution of two kinds of particles within the matrix. One is dark fine particle marked by a black arrow in FIG. 5C, and the other is grey blocky particles which are significantly bigger compared to the fine particles. The blocky particles are lighter in the optical images, compared to the HEA particles. FIG. 6A-FIG. 6B shows backscattered electron images of both as-cast samples. The two different kinds of particles are more distinguishable in this figure, where the grain structure of the Al matrix is also revealed. It is observed that a large number of particles are located in grain interiors, instead of being pushed to the grain boundary. These results suggest that ultrasonic processing was effective in dispersing HEA particles during solidification of aluminum. It was reported that, during the ultrasonic processing, the irradiation of the high energy from the high-intensity vibration leads to the formation of cavitation and consequent implosion of cavities (Suryanarayana. *Prog. Mater. Sci.* 2001, 46, 1-184; Xu et al. *Mater. Lett.* 2004, 58, 3669-3673; Han. *Metallurgical and Materials Transactions B,* 2015, 46(4), 1603-1614). As a result, strong extensive shock waves are produced in the liquid metal, which disperse particles in the molten Al from particle agglomerations (Liu et al. *Journal of Materials Processing Technology,* 2012, 212(2), 365-371).

Figure 7:
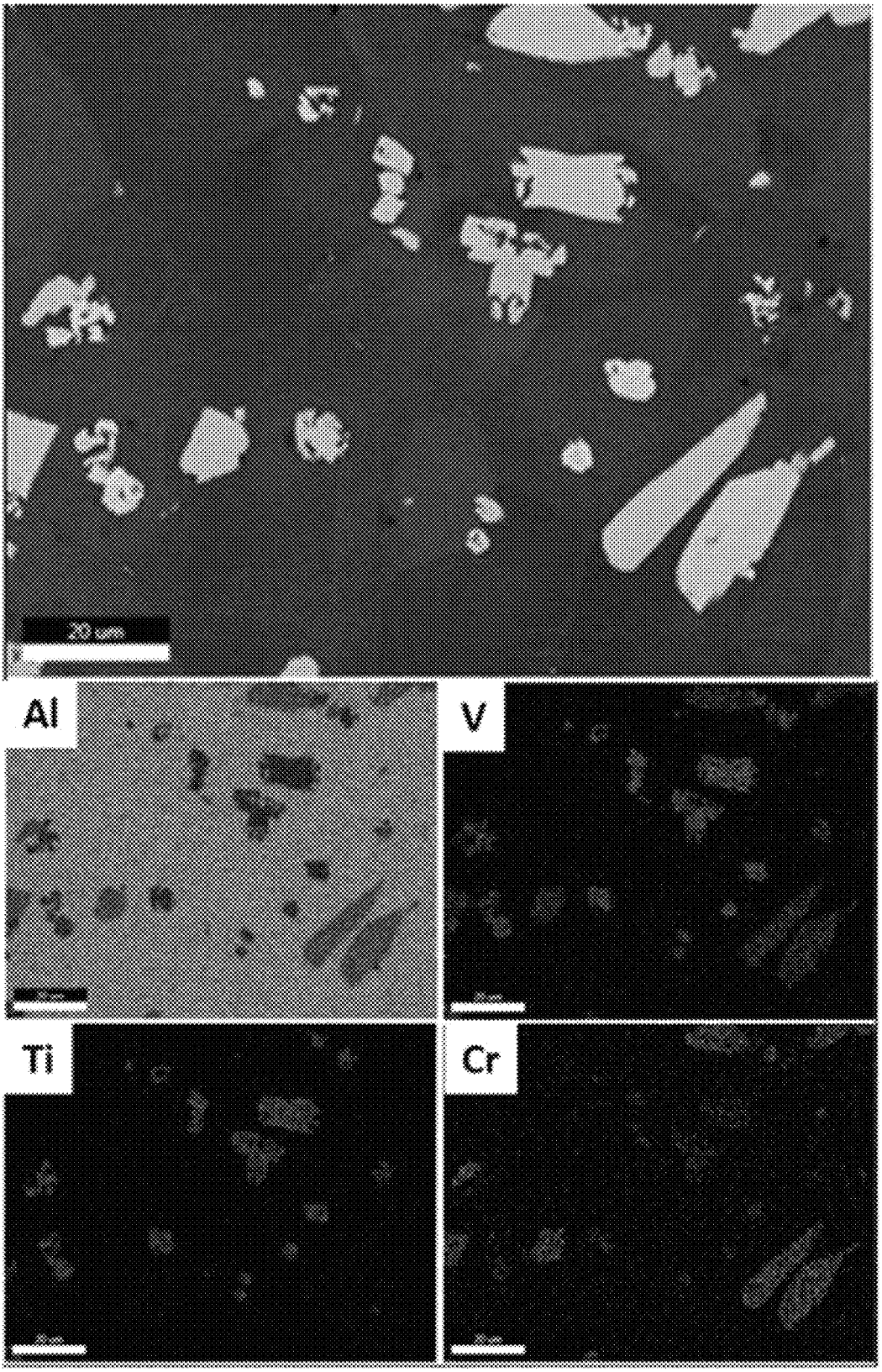
FIG. 7. EDS mapping of Al with 6 wt. % HEA particle addition showing the distribution of elements, Al, Cr, Ti and V.
Figure 8A:
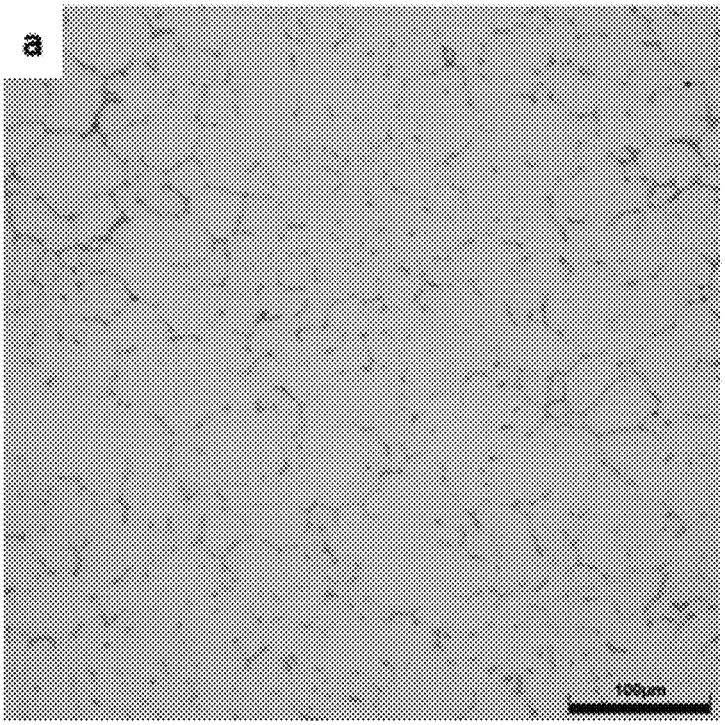
FIG. 8A. Optical micrograph of 7075.
Figure 8B:
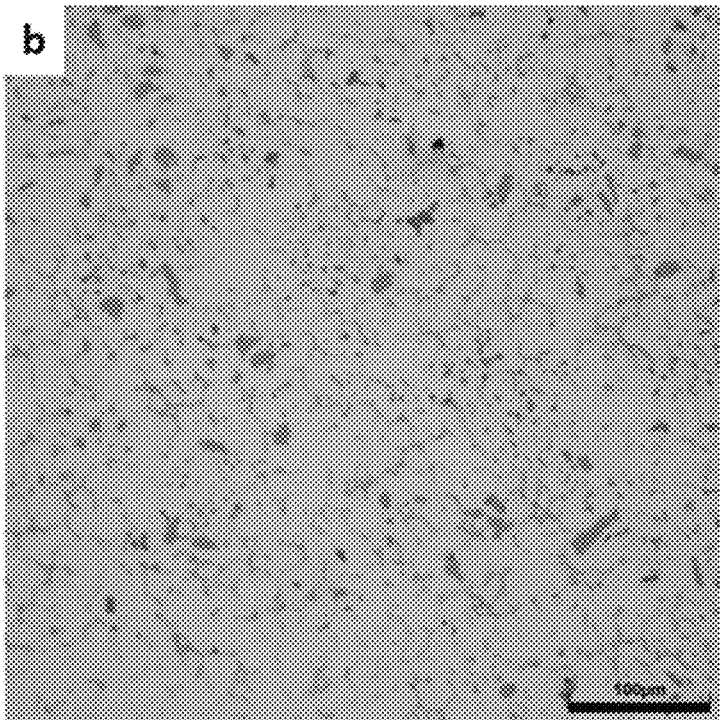
FIG. 8B. Optical micrograph of 7075 with 3 wt. % HEA particle addition.

FIG. 7 is the EDS mapping of a representative area in the pure aluminum sample with 6 wt. % addition. It is observed that the fine particles contain all four elements, i.e., Al, Cr, Ti and V, while the blocky particles contain only Al, Cr and V.

Figure 9A:
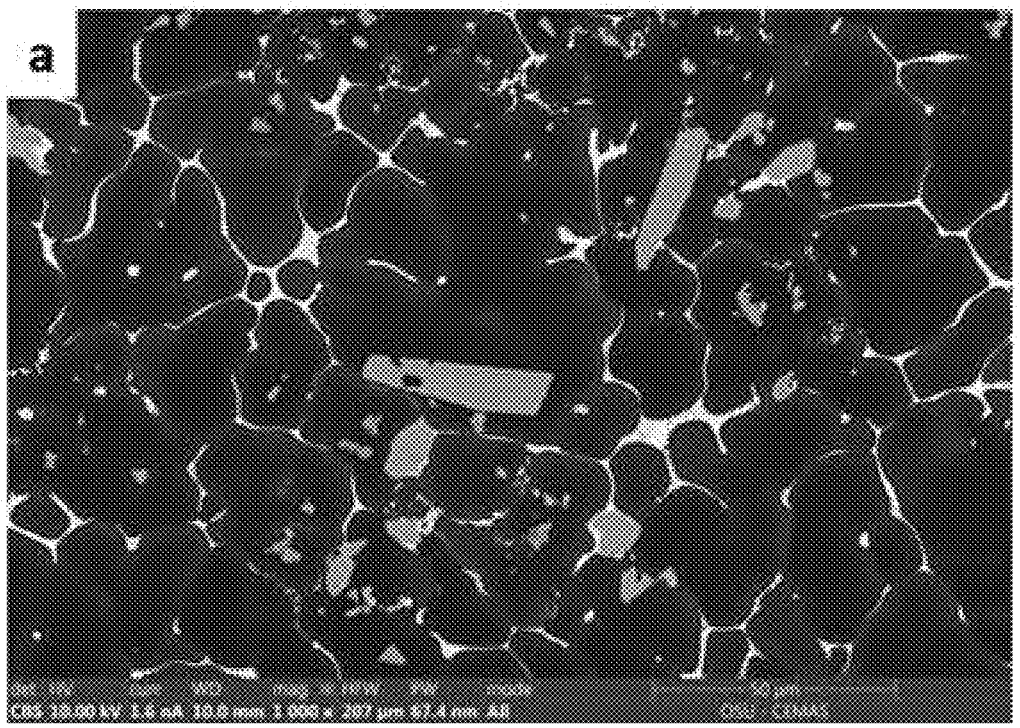
FIG. 9A. Low magnification backscattered electron image 7075 with 3 wt. % HEA addition.
Figure 9B:
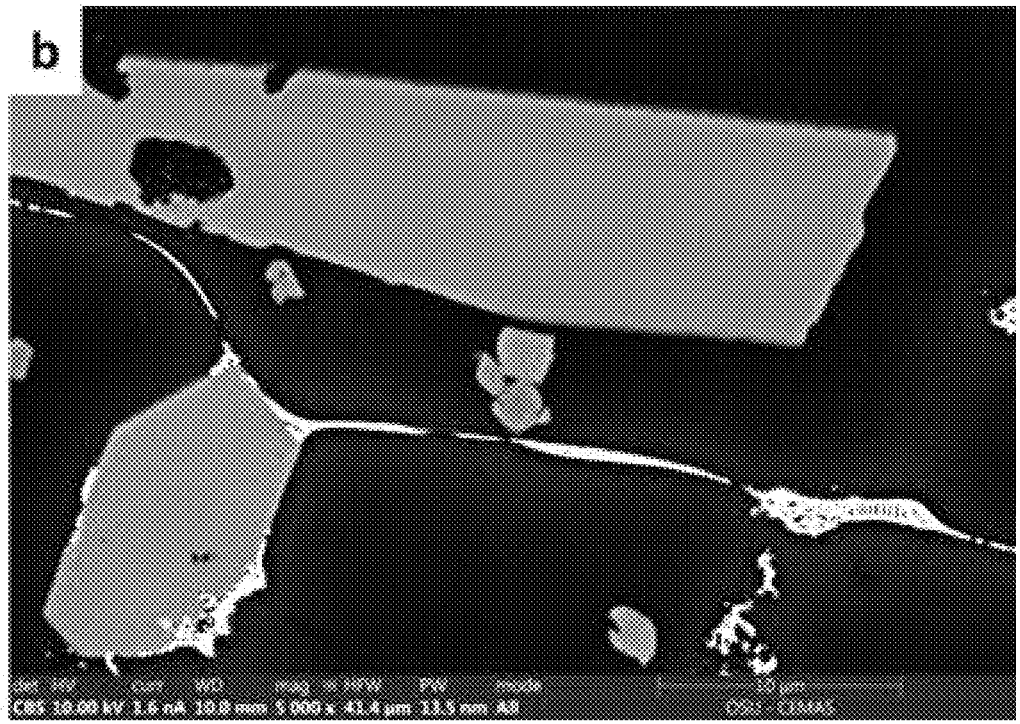
FIG. 9B. High magnification backscattered electron image 7075 with 3 wt. % HEA addition.
Figure 10:
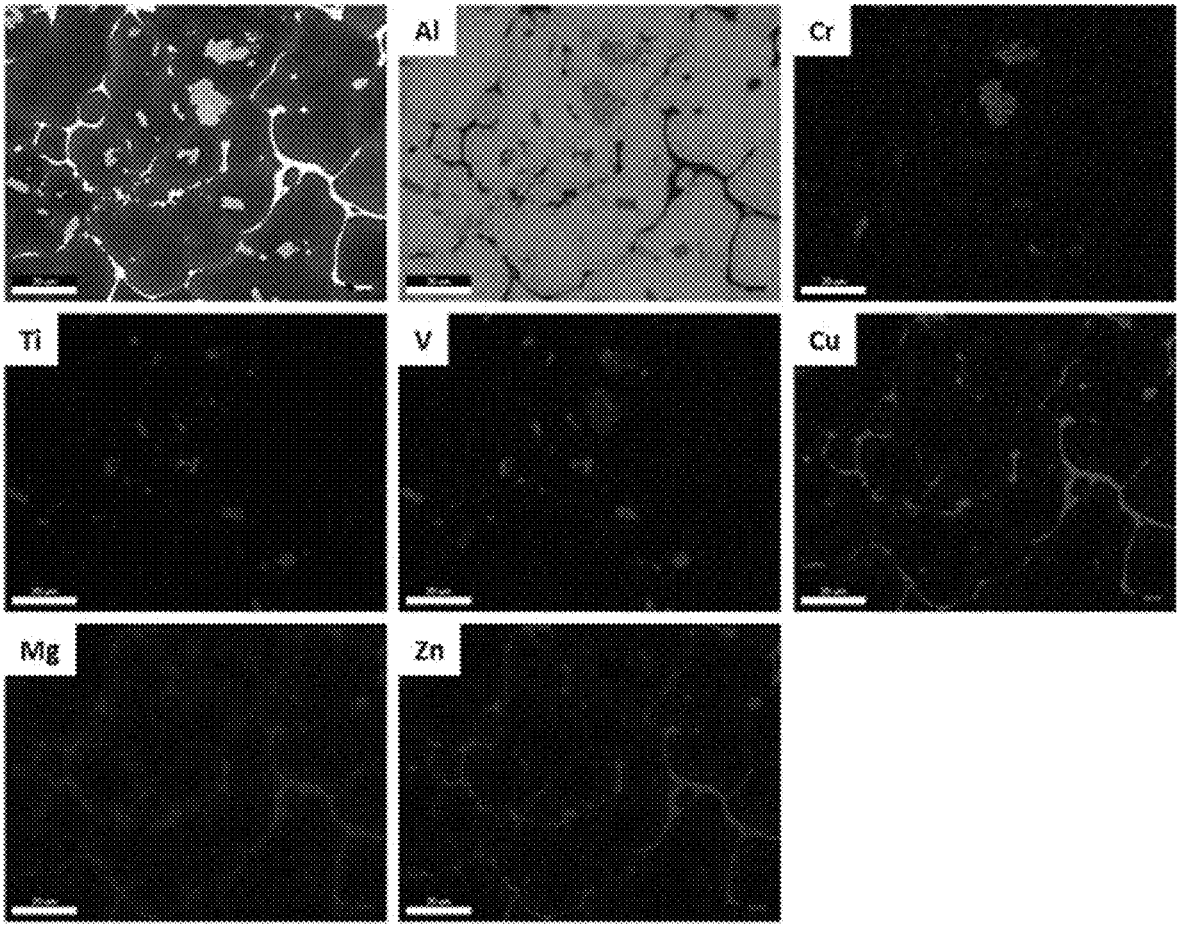
FIG. 10. EDS mapping of 7075-3 wt. % HEA sample showing the distribution of elements, Al, Cr, Ti, V, Cu, Mg and Zn.

FIG. 8A-FIG. 8B and FIG. 9A-FIG. 9B are optical micrographs and backscattered electron image of 7075 alloy and 7075 alloy with 3 wt. % HEA particle addition. Both 7075 and 7075-HEA samples showed equiaxed alpha aluminum grain structure. With HEA particles added, the grain size was significantly reduced. FIG. 10 is the EDS mapping on the 7075-3 wt. % HEA composite, highlighting the distribution of Al, Cr, Ti, V, Cu, Mg and Zn. The EDS results indicate that the solute elements, mainly Mg, Zn and Cu, are segregated to the inter-dendritic regions during non-equilibrium solidification processing of 7075 and 7075-HEA samples. It is also clear in FIG. 8A-FIG. 10 that a eutectic microstructure was formed at the inter-dendritic regions. According to a previous study on 7075 alloy (Fan et al. *Mater. Lett.* 2006, 60, 1475-1479), the eutectic microstructure comprised Al and $Mg(Zn,Cu,Al)_2$ phase, which is in good agreement with the EDS results in this investigation. Similar to the behavior in pure aluminum samples, there are both fine and blocky particles present in the matrix, and most particles are evenly distributed within the dendrites, due largely to ultrasonic processing.

Figure 11A:
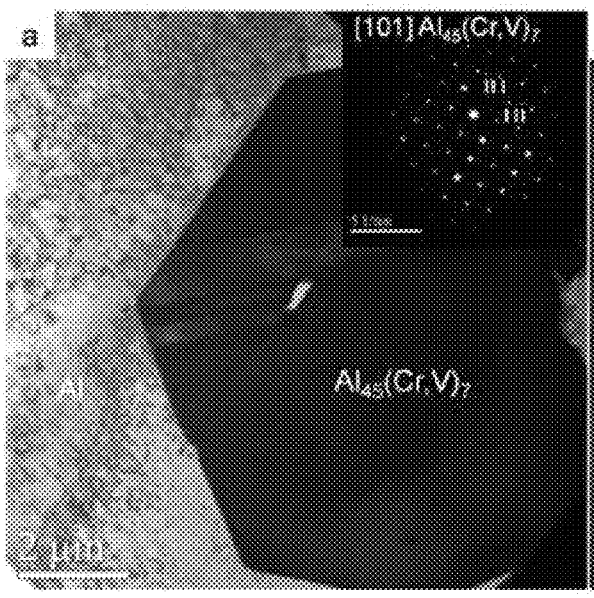
FIG. 11A. TEM characterization of blocky particles in as-cast 7075 alloy with 3 wt. % addition of high entropy alloy particle. Bright-field TEM image with an inset selected area diffraction pattern along [101] zone axis of $Al_{45}(Cr,V)_7$ phase.
Figure 11B:
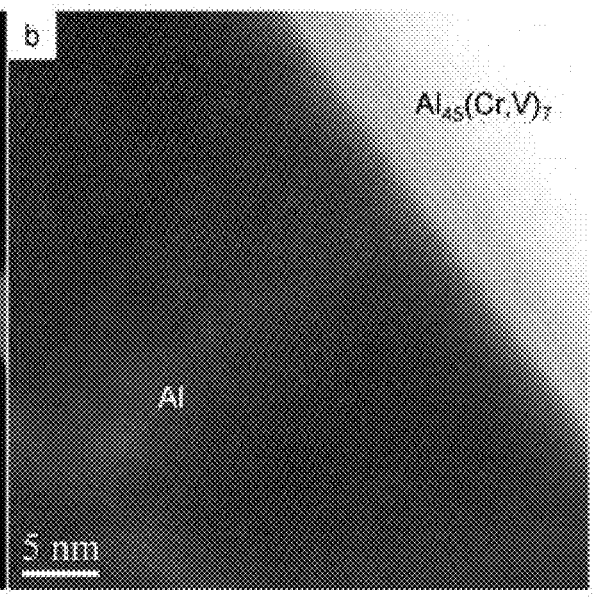
FIG. 11B. STEM characterization of blocky particles in as-cast 7075 alloy with 3 wt. % addition of high entropy alloy particle. Atomic resolution HAADF-STEM image of the interface between $Al_{45}(Cr,V)_7$ phase and aluminum matrix.
Figure 12A:
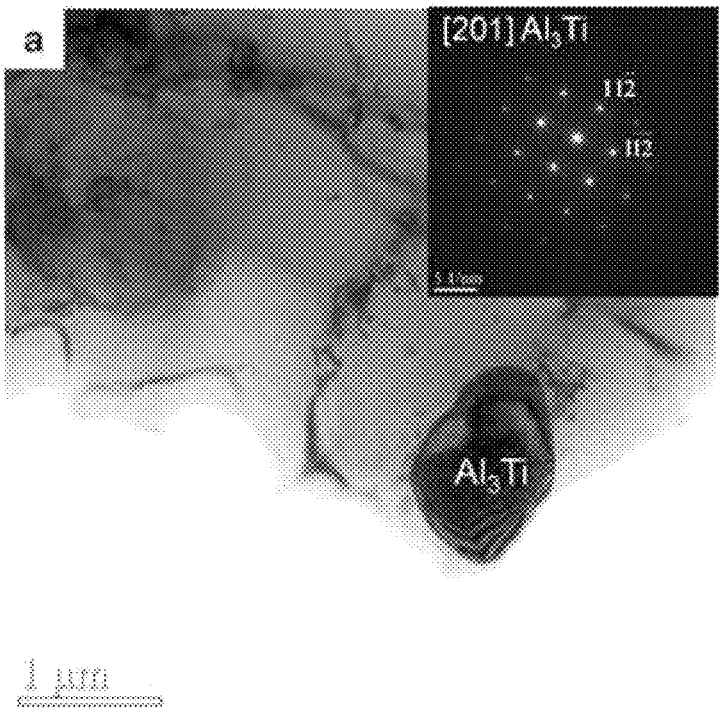
FIG. 12A. TEM characterization of fine particles in as-cast 7075 alloy with 3 wt. % addition of high entropy alloy particle. Bright-field TEM image with an inset selected area diffraction pattern along [201] zone axis of $Al_3Ti$ phase.
Figure 12B:
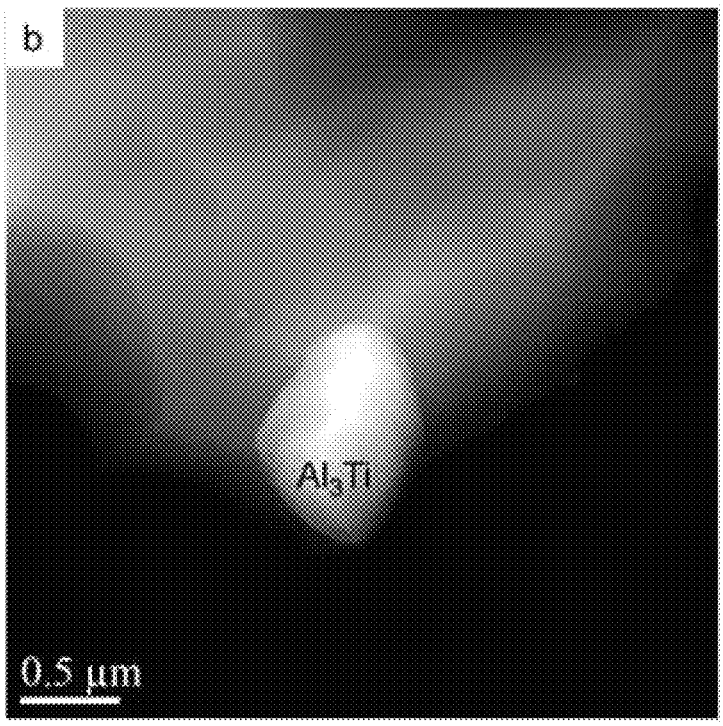
FIG. 12B. STEM characterization of fine particles in as-cast 7075 alloy with 3 wt. % addition of high entropy alloy particle. HAADF-STEM image of $Al_3Ti$ phase.

In order to identify the two groups of particles (blocky and fine particles) existing in the composite samples, transmission electron microscopy (TEM) analysis was carried out on 7075-HEA samples. FIG. 11A is a bright field TEM image of a blocky particle within aluminum matrix. A selected area diffraction pattern (SADP) study shows that the blocky particle is of $Al_{45}Cr_7$ phase structure (monoclinic, space group C12/m1, lattice parameters: a=2.5196 nm, b=0.7574 nm, c=1.0949 nm) (Villars et al. Cr7Al45 Crystal Structure: Datasheet from "PAULING FILE Multinaries Edition—2012" in SpringerMaterials, https://materials.springer.com/isp/crystallographic/docs/sd_0528428). The SADP along [101] zone axis of $Al_{45}Cr_7$ is inset in FIG. 11A. The composition of the blocky particle was measured using energy-dispersive X-ray spectroscopy (EDS) in TEM, and the results are listed in Table 1. The EDS results show that there is significant solubility of V and a small amount of Ti, Cu, Zn, Mg in the $Al_{45}Cr_7$ phase. Thus, the phase is expressed as $Al_{45}(Cr,V)_7$ thereafter. The interface between 7075 matrix and $Al_{45}(Cr,V)_7$ phase was further examined via atomic resolution high-angle annular dark-field (HAADF) STEM. The HAADF-STEM image in FIG. 11B shows the interface between Al matrix and the blocky $Al_{45}(Cr,V)_7$ particle. There is no amorphous layer observed at the interface. FIG. 12A shows a bright field (BF) TEM image of the fine particle in the 7075-HEA sample. A SADP study identifies the fine particle as $DO_{22}$ $Al_3Ti$ phase (tetragonal, space group I4/mmm, lattice parameter: a=0.38467 nm, b=0.38467 nm, c=0.86 nm) (Villars et al. Al3Ti (TiAl3 ht) Crystal Structure: Datasheet from "PAULING FILE Multinaries Edition—2012" in SpringerMaterials, https://materials.springer.com/isp/crystallographic/docs/sd_1617089), and the SADP along [201] zone axis of $Al_3Ti$ phase is given in FIG. 12B. Its composition was also determined using EDS and given in Table 1. There is small solubility of Cr and V in the $Al_3Ti$ phase as indicated in Table 1. No original AlCrTiV HEA particles with a B2 structure were found in the sample.

TABLE 1

Composition of blocky particle and fine particle determined using EDS (at. %)

| | Al | Cr | Ti | V | Cu | Zn | Mg |
|---|---|---|---|---|---|---|---|
| Blocky particle | 80.2 | 10.7 | 0.7 | 5.1 | 2.0 | 0.8 | 0.5 |
| Fine particle | 69.4 | 0.9 | 23.4 | 6.3 | | | |

Figure 13A:
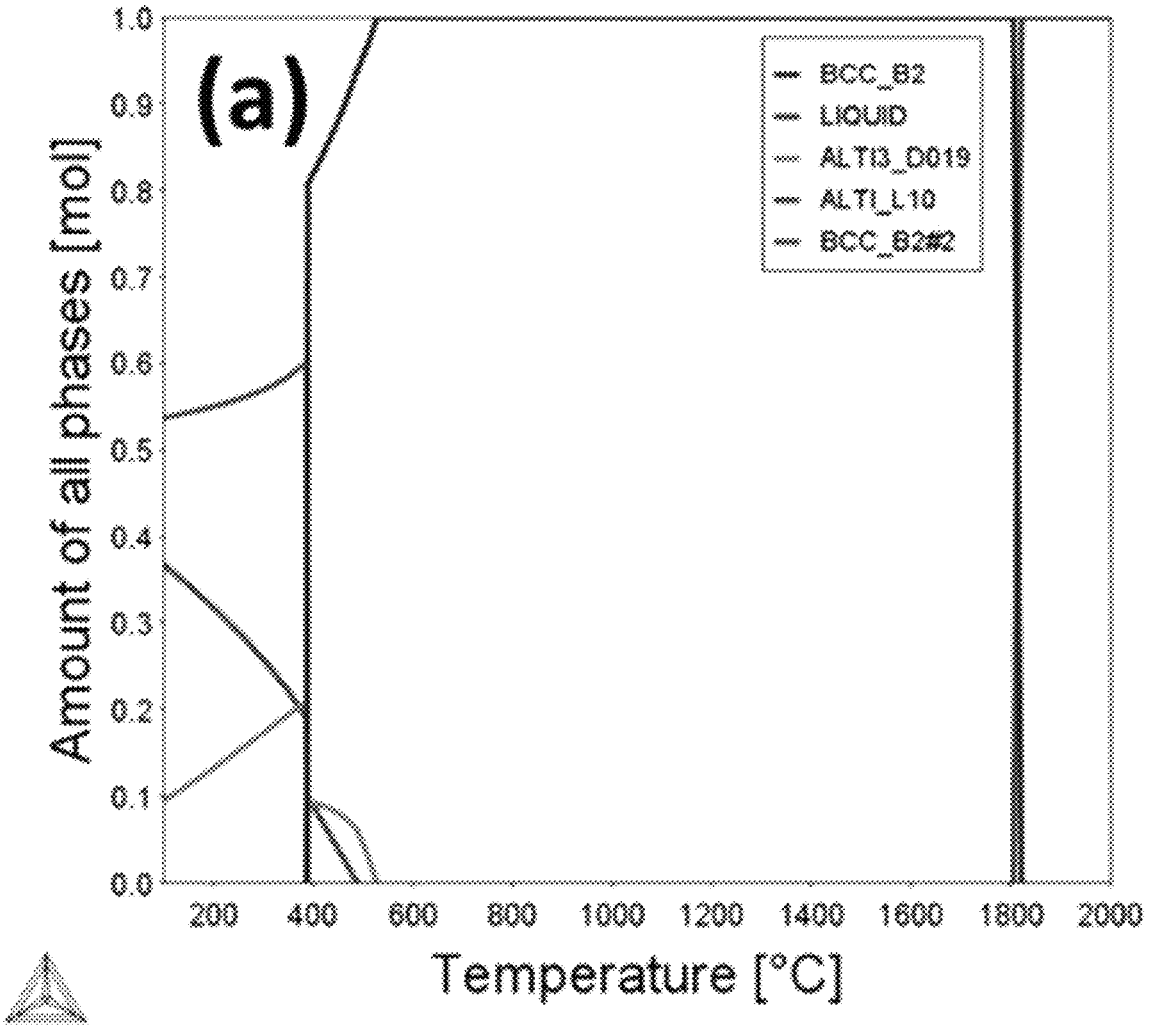
FIG. 13A. Equilibrium phase evolution with temperature of AlCrTiV.
Figure 13B:
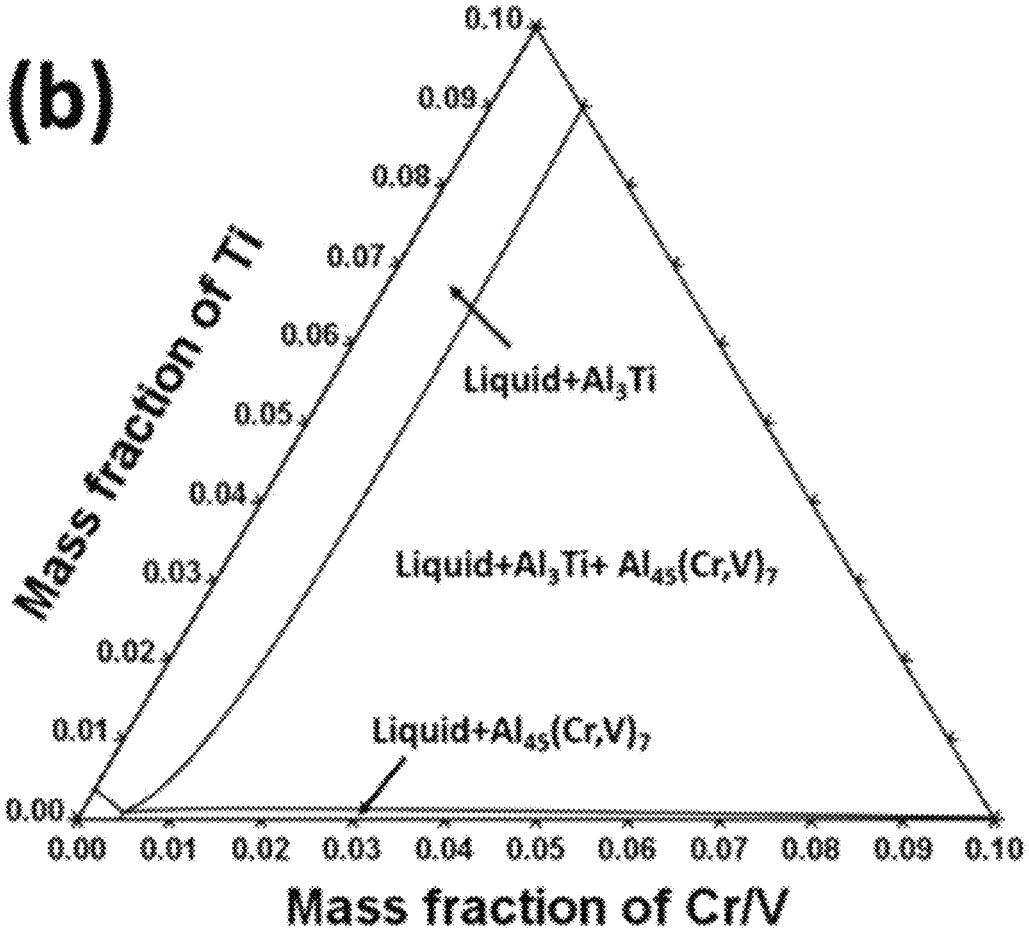
FIG. 13B. Isothermal phase diagram of a pseudo ternary system Al—Ti—Cr/V at 750° C., which is the holding temperature for the molten aluminum. In this phase diagram, mass fraction of Cr and V are kept at 1:1 ratio.

FIG. 13A shows the calculated equilibrium phase evolution with temperature of AlCrTiV, using ThermoCalc software. From the calculated phase evolution, the melting temperature of AlCrTiV is 1805° C., which is much higher than that of the melting temperature. Even though AlCrTiV is with a high melting temperature of 1805° C., the Cr, Ti and V elements all have solubilities in molten aluminum and can be dissolved into the molten Al. FIG. 13B is the calculated Al—Ti—Cr/V pseudo ternary isothermal section at 750° C., using ThermoCalc software. The bottom left vertex represents pure aluminum. The ratio between mass fraction of Cr and V is 1 to 1. According to the phase diagram, $Al_{45}(Cr,V)_7$ and $Al_3Ti$ are both stable in molten aluminum at 750° C. Therefore, $Al_{45}(Cr,V)_7$ and $Al_3Ti$ phases in as-cast materials were formed via the reactions between molten aluminum and AlCrTiV particles, which explains why there was no original AlCrTiV particles of BCC_B2 crystal structure found in the composite samples. During solidification alpha aluminum solidified around $Al_{45}(Cr,V)_7$ and $Al_3Ti$ particles, which leads to in-situ formation of these particles mostly sitting inside the alpha aluminum grains (Ma et al. *J. Alloys Compd.* 2019, 792, 365-374; Wang et al. *Mater. Sci. Eng. A.* 2004, 364, 339-345; Liu et al. *Mater. Sci. Eng. A.* 2018, 710, 392-399). Additionally, extra heterogenous nucleation sites provided by the in-situ formed $Al_{45}(Cr,V)_7$ and $Al_3Ti$ particles resulted in the refinement of alpha aluminum grain structure.

In 7075-3 wt. % HEA alloy, the sizes of $Al_3Ti$ particles are significantly smaller than those of $Al_{45}(Cr,V)_7$. Thus, it is reasonable to assume that $Al_3Ti$ phase has more contribution to strengthening of the composites than $Al_{45}(Cr,V)_7$ phase. A previous study suggests that $Al_3Ti$ phase is an effective strengthening phase in fabricated Al based composites (Adamiak et al. *Journal of Materials Processing Technology,* 2004, 155-156, 2002-2006). $Al_3Ti$ phase formed through in-situ processes has strong bonding to aluminum matrix (Choi et al. *Metallurgical Transactions A,* 1992, 23, 2387-2392), leading to a significant improvement in mechanical performances (Ma et al. *J. Alloys Compd.* 2019, 792, 365-374; Nofar et al. *Materials and Design,* 2009, 30, 280-286). Such strong interfacial bonding is attributed to the good compatibility between face-centered cubic aluminum matrix and $Al_3Ti$ with a tetragonal structure (Nofar et al. *Materials and Design,* 2009, 30, 280-286).

Mechanical properties of as-cast materials. Representative stress-strain curves of Al and Al-HEA composites are plotted in FIG. 14, and the tensile properties of pure Al and Al-HEA composites are summarized in Table 2. The yield strength is defined by the 0.2% offset strain. It is evident that the additions of HEA particles led to significant improvements in tensile properties compared to commercially pure aluminum. With addition of 3 wt. % of HEA particles, the composite shows 38% increase in yield strength and 54% increase in ultimate tensile strength respectively, compared to commercially pure aluminum, with essentially no loss in elongation. With addition of 6 wt. % of HEA particles, the composite has 63% increase in yield strength and 81% increase in ultimate tensile strength, respectively. Unlike the composite with 3 wt. % HEA particles, however, the composite with 6 wt. % HEA particles suffered a considerable loss in ductility. The elongation at break decreases 60% when compared with the Al-3 wt. % HEA composite. This large loss of elongation when increasing particle addition from 3 wt. % to 6 wt. % is attributed the coarsening $Al_{45}(Cr,V)_7$ blocky particles. It is clear in FIG. 6A-FIG. 6B that the $Al_{45}(Cr,V)_7$ particle size in 6 wt. % addition sample is considerably larger than it in 3 wt. % addition sample.

TABLE 2

Summary of mechanical properties of pure Al and Al-HEA composites

| | Yield strength (MPa) | UTS (MPa) | Elongation (%) | Elastic Modulus (GPa) |
|---|---|---|---|---|
| Al | 30.6 | 57.8 | 49.1 | 66.6 |
| Al-3 wt. % HEA | 42.3 | 89.2 | 46.8 | 70.4 |
| Al-6 wt. % HEA | 49.8 | 104.7 | 18.7 | 73.7 |

Figure 15:
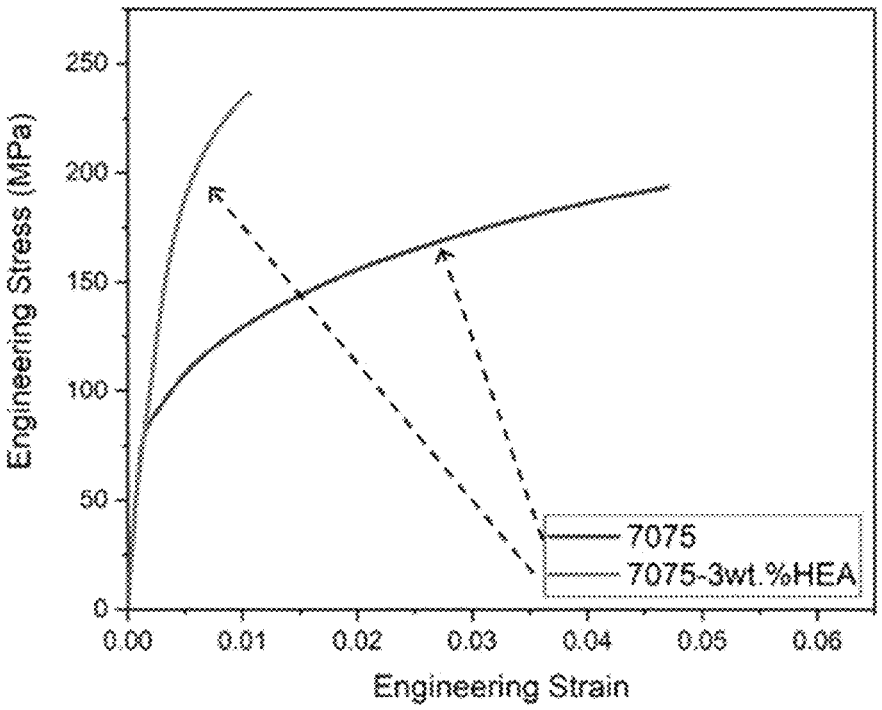
FIG. 15. Engineering stress-strain curves of 7075 and 7075-3 wt. % HEA composite.

FIG. 15 shows representative stress-strain curves of 7075 and 7075-3 wt. % HEA samples, with their tensile properties summarized in Table 3. Due to the lack of proper degassing process, both base 7075 alloy and 7075-3 wt. % HEA sample showed very limited elongation. Also, due to the high Zn and Mg contents in the base alloy, the 7075 cast specimens are prone to oxidation and inclusions. In 7075-3 wt. % HEA sample, high density of in-situ formed particles agglomerated with $Mg(Zn,Cu,Al)_2$ phase on the grain boundary, as shown in FIG. 9A-FIG. 9B, causing stress concentration and likely poor bonding between intermetallic phases. All these factors lead to the limited elongation in the 7075-3 wt. % HEA sample. However, the 7075-3 wt. % HEA sample had more than 80% increase in yield strength and about 17% increase in ultimate tensile strength. Compared to Al-based composites, the HEA particle addition showed the most significant improvement on yield strength and ultimate tensile strength when particles were added into 7075 base alloy.

TABLE 3

Summary of mechanical properties of 7075-HEA composites

| | Yield Strength (MPa) | UTS (MPa) | Elongation (%) | Elastic Modulus (GPa) |
|---|---|---|---|---|
| 7075 | 99.7 | 201.7 | 4.7 | 69.0 |
| 7075-3 wt. % HEA | 182.3 | 236.6 | 1.1 | 71.4 |

For samples with AlCrTiV high entropy alloy particle additions, the increase in yield strength can be attributed to three mechanisms. First, the significant grain refinement caused by heterogenous nucleation on the in-situ formed $Al_{45}(Cr,V)_7$ and $Al_3Ti$ particles contributes to the increase of yield strength, according to the well-known Hall-Petch equation. Second, the formation of in-situ $Al_{45}(Cr,V)_7$ and $Al_3Ti$ particles act as the obstacles to dislocation movement; since these particles are mostly located in grain interiors, the dispersion strengthening effect is more pronounced. Third, with the presence of hard particles like $Al_{45}(Cr,V)_7$ and $Al_3Ti$, more load transfer to hard particles via the interface between matrix and $Al_{45}(Cr,V)_7/Al_3Ti$. Finally, the strengthening effect increases with higher volume fraction of hard particles (Wang et al. *Mater. Sci. Eng. A.* 2004, 364, 339-345).

Figure 16A:
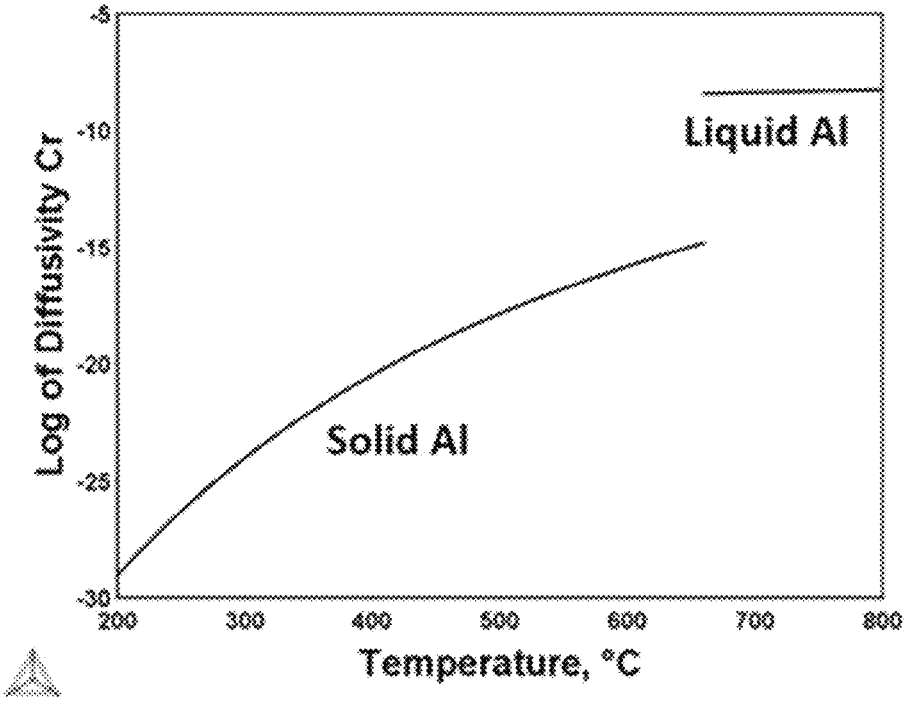
FIG. 16A. Impurity diffusivity of Cr in solid and molten aluminum.
Figure 16B:
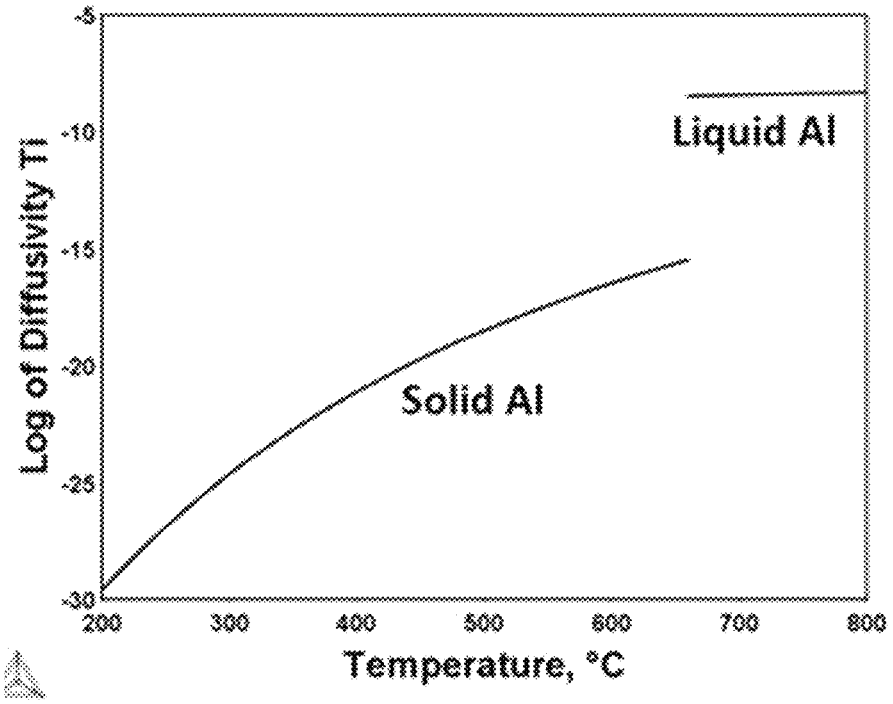
FIG. 16B. Impurity diffusivity of Ti in solid and molten aluminum.

Role of interactions between molten aluminum and HEA particles. The interactions, including thermodynamic reactions and kinetic diffusion, between the matrix alloys and the reinforcement additions during aluminum matrix composite processing is important in controlling the interfacial strength and the final microstructure of the composites (Lloyd, *Int. Mater. Rev.* 1994, 39, 1-23; Shi et al. *Metallurgical and Materials Transactions A,* 2019, 50A, 3736-3747). A certain amount of reactions can promote interfacial wetting during processing and bonding in the final solidification products. However, excessive reactions can lead to the formation of brittle intermetallic phases in the matrix/particle interfaces, degrading the properties of the composites. In this study, AlCrTiV HEA particles have a strong thermodynamic driving force to react with molten Al to form $Al_{45}(Cr,V)_7$ and $Al_3Ti$ phases according to the phase diagram in FIG. 13A-FIG. 13B. For the samples herein, the AlCrTiV HEA particles are completely consumed in the reactions during composite processing. In comparison, in other HEA particle reinforced composites fabricated through powder metallurgy, HEA particles only form a layer of intermetallic phase on the interface with aluminum matrix (Liu et al. *J. Alloys Compd.* 2019, 780, 558-564; Yuan et al. *J. Alloys Compd.* 2019, 806, 901-908). FIG. 16A-FIG. 16B is the impurity diffusivity of Cr and Ti in solid and molten aluminum, exported from mobility database in Thermo-Calc. In molten aluminum, the diffusivity of elements (such as Cr and Ti) is multiple orders of magnitude higher than diffusivity in solid aluminum. Thus, although AlCrTiV HEA particles were only held in molten aluminum for minutes, they were fully transformed into intermetallic phases.

In this study, it is believed that the formed $Al_{45}(Cr,V)_7$ and $Al_3Ti$ phases, unlike most ceramic particles, have more coherent interfaces with aluminum matrix, thus, excellent wetting during solidification processing, and significantly improved mechanical properties in the composite materials. Based on these discussions, two routes will be considered for future research: 1) Reducing interfacial reactions to preserve HEA particles, which can be achieved via reducing melt holding time or surface passivation treatments of HEA particles. 2) Refining reaction products, which can be achieved via higher cooling rates during casting or some modification treatments.

Conclusions. Equiatomic AlCrTiV high entropy alloy particles (up to 6 wt. %) can be successfully introduced to commercially pure Al and 7075 alloy, using a liquid mixing and casting process assisted by ultrasonic vibration.

In both pure Al and 7075 aluminum alloy, after holding for about 10 min., the added HEA particles reacted with molten aluminum to form $Al_{45}(Cr,V)_7$ and $Al_3Ti$ particles, which are uniformly distributed in the microstructure of resultant composite materials. Those particles acted as heterogeneous nucleation sites during solidification, leading to refined grain structure.

The aluminum matrix composite samples with HEA particle additions showed significant improvement in yield strength and ultimate tensile strength. Such improvement is due to grain refinement, dispersion strengthening provided by in-situ particle formation, and strong particle/matrix interfacial strength.

The research suggests that matrix/particle interfacial reactions help the dispersion of particles into molten aluminum. However, high diffusion rate of elements in molten aluminum causes the complete consumption of original HEA particles in such interfacial reactions. Therefore, it can be important to control the matrix/particle interfacial reactions for developing future castable HEA particle reinforced aluminum matrix composites.

Example 2—Metal Matrix Composites reinforced by High Entropy Alloys

Metal matrix composites (MMCs) have attractive physical and mechanical properties, such as low density, high strength, high wear resistance, and good high-temperature performance, for aerospace, defense and automotive industries. Traditionally, ceramic particles are used as the reinforcements in aluminum matrix composites (Lloyd D J. *Int Mater Rev.* 1994, 39, 1-23). The common reinforcement particles include SiC, $SiO_2$, WC, $Al_2O_3$, etc. Although ceramic particles have the advantages of high hardness, high elastic modulus, and high thermal stability, they generally have poor wettability with molten metal, which poses significant challenges to the manufacture of MMCs (non-uniform dispersion of reinforcement and poor matrix reinforcement interfacial bonding) and negatively impacts their mechanical properties.

Many high entropy alloys (HEAs), such as the lightweight AlCrTiV alloys (US 2018/0119255), have high hardness and high elastic modulus, thus are more desirable reinforcements for MMCs than ceramics, since HEAs being metallic materials generally have better wettability with matrix alloys than non-metallic ceramics.

Disclosed herein are metal matrix composites (MMC) reinforced by high entropy alloys (HEAs). Also disclosed herein are methods for:

1. Selecting most compatible HEA reinforcement for a matrix alloy in terms of controllable reactivity for wettability and interfacial bonding.

2. Manufacturing HEA-reinforced MMC using a low-cost melting-and-casting method. An ultrasonic dispenser device, comprising an ultrasonic generator, a transducer, and a horn to transmit ultrasonic vibration into MMC melt, can be added to improve HEA dispersion in the MMC materials (FIG. 1).

Mixed matrix composites reinforced by HEAs can offer tremendous improvements in the physical and mechanical properties (including the modulus, strength, thermal conductivity, etc.) of monolithic alloys based on (but not limited to) aluminum, magnesium, titanium, copper, etc. These MMCs can be used in transportation, defense, and consumer products, among others.

Al—AlCrTiV MMC: Pure Al and equiatomic AlCrTiV high entropy alloy (HEA) have controllable reactivity. FIG. 6A and FIG. 6B shows the backscattered electron image of Al-3 wt. % HEA composite and Al-6 wt. % HEA composite, showing relatively uniform distributions of HEA particles in pure Al matrix.

Figure 14:
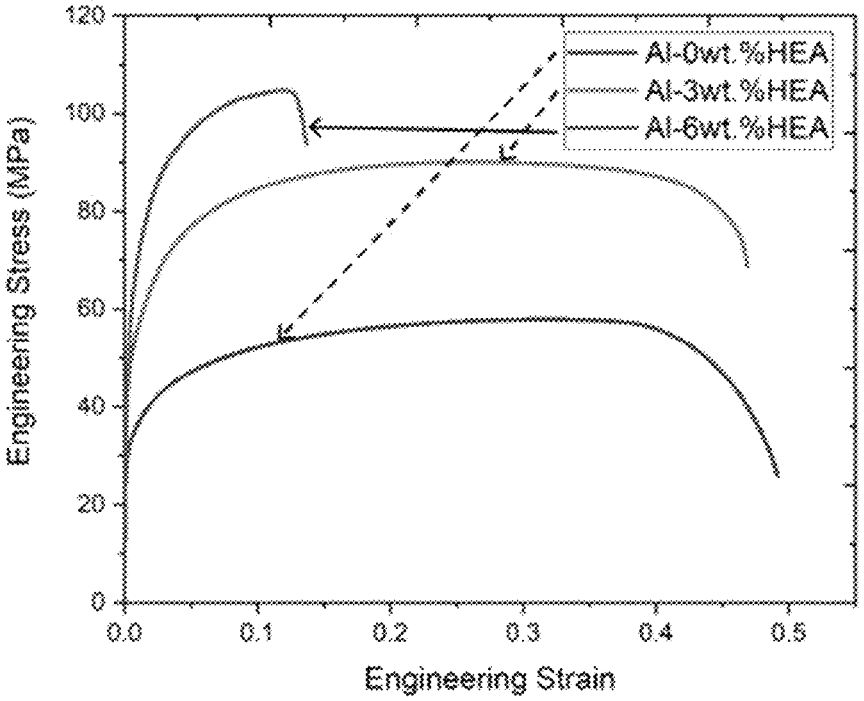
FIG. 14. Engineering stress-strain curves of commercial pure Al and Al-HEA composites.

Table 2 and FIG. 14 show typical mechanical properties of as-cast Al-HEA MMC samples compared with those pure Al sample. With addition of 3 wt. % of HEA particles, the composite shows 38% increase in yield strength and 54% increase in ultimate tensile strength respectively, with almost no reduction in elongation, compared to commercially pure aluminum. With addition of 6 wt. % of HEA particles, the composite has 63% increase in yield strength and 81% increase in ultimate tensile strength, respectively. Unlike the composite with 3 wt. % HEA particles, the composite with 6 wt. % HEA particles suffered significant loss in ductility. The elongation at break decreases 60% when compared with the Al-3 wt. % HEA composite. The significant drop in the ductility may be due to the large $Al_{45}(Cr,V)_7$ phase that forms when large amount of HEA particles was added.

Figure 17A:
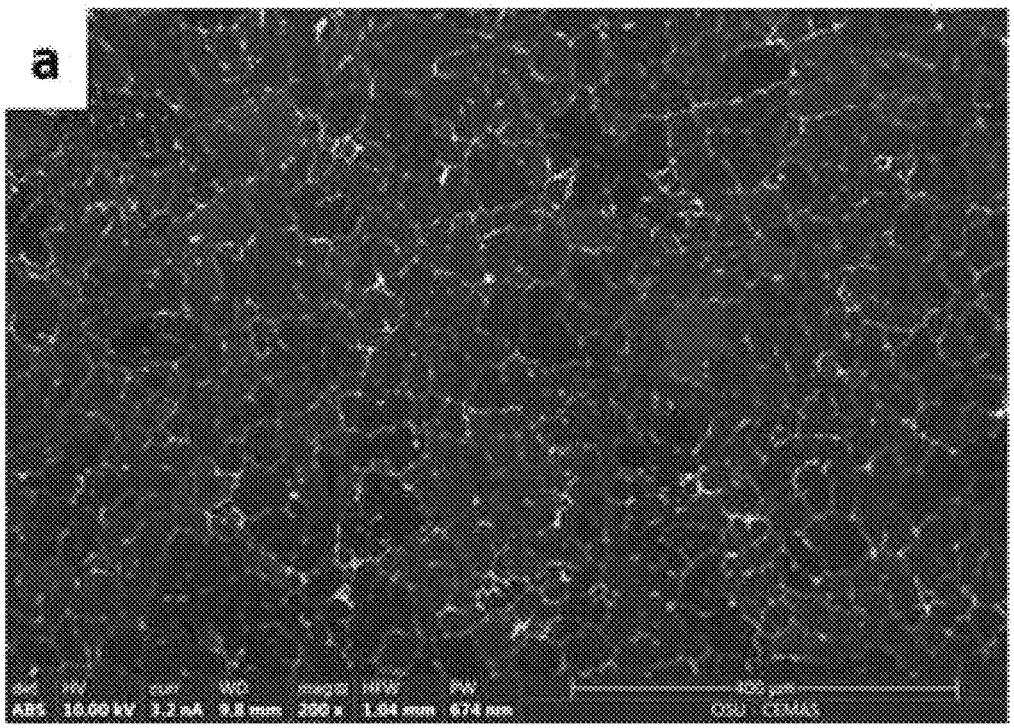
FIG. 17A. Backscattered electron image of 7075.
Figure 17B:
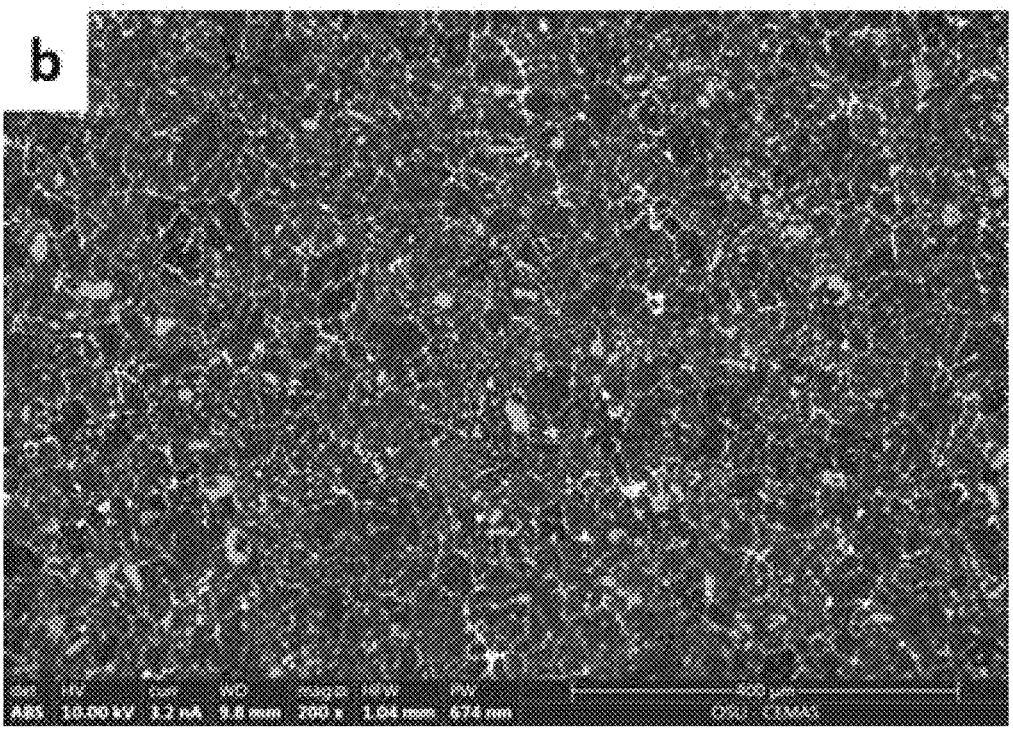
FIG. 17B. Backscattered electron image 7075-3 wt. % HEA composite.

7075-AlCrTiV MMC: FIG. 17A-FIG. 17B shows the backscattered electron images of aluminum alloy 7075 and 7075-3 wt. % HEA (AlCrTiV) composite, respectively. The MMC sample shows a rather uniform distribution of HEA particles.

Table 3 and FIG. 15 show typical mechanical properties of as-cast 7075 alloy and 7075-HEA MMC samples. Despite the low elongation which is due to the lack of degassing operation, the HEA particles provided about 83% increase in yield strength.

Figure 18A:
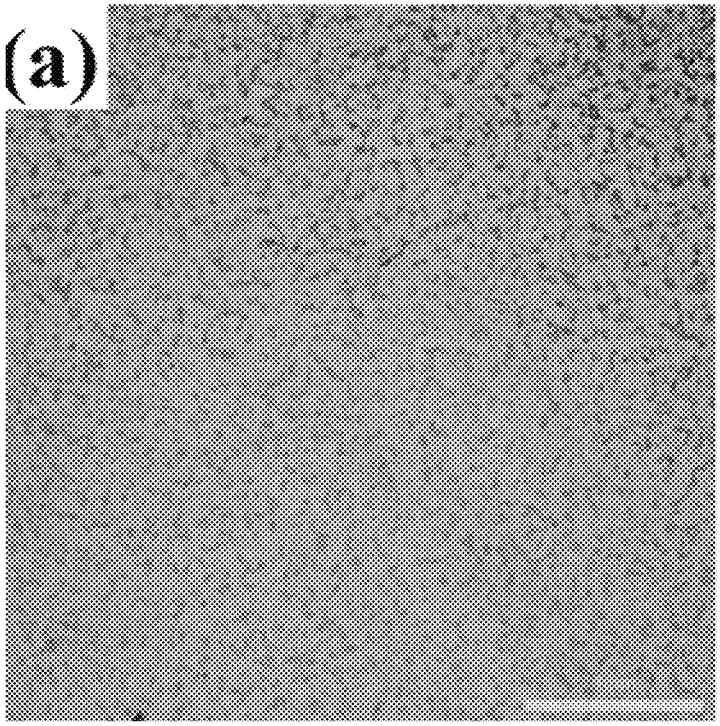
FIG. 18A. Optical micrograph of Mg alloy MMC sample.
Figure 18B:
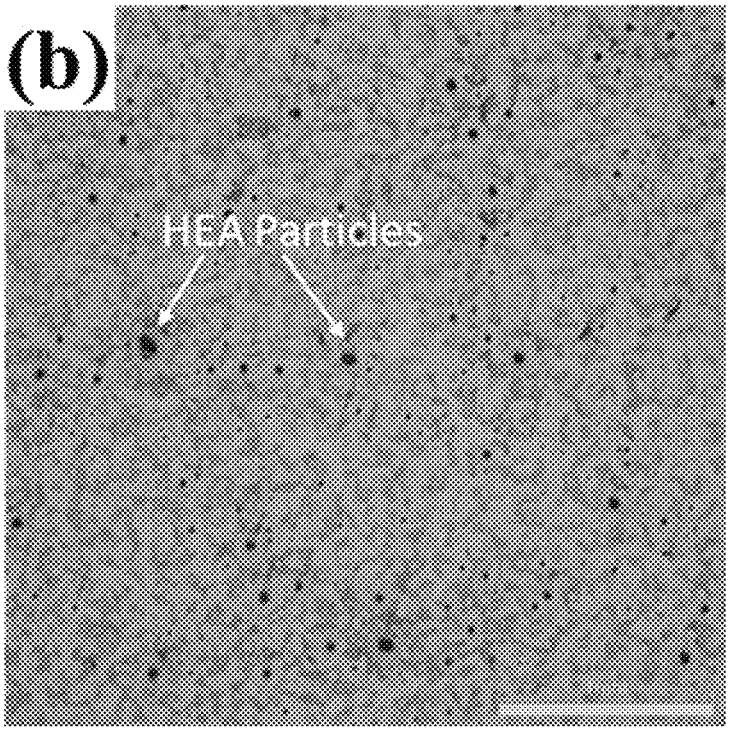
FIG. 18B. Optical micrograph of AZ91-AlCrTiV MMC sample.
Figure 18C:
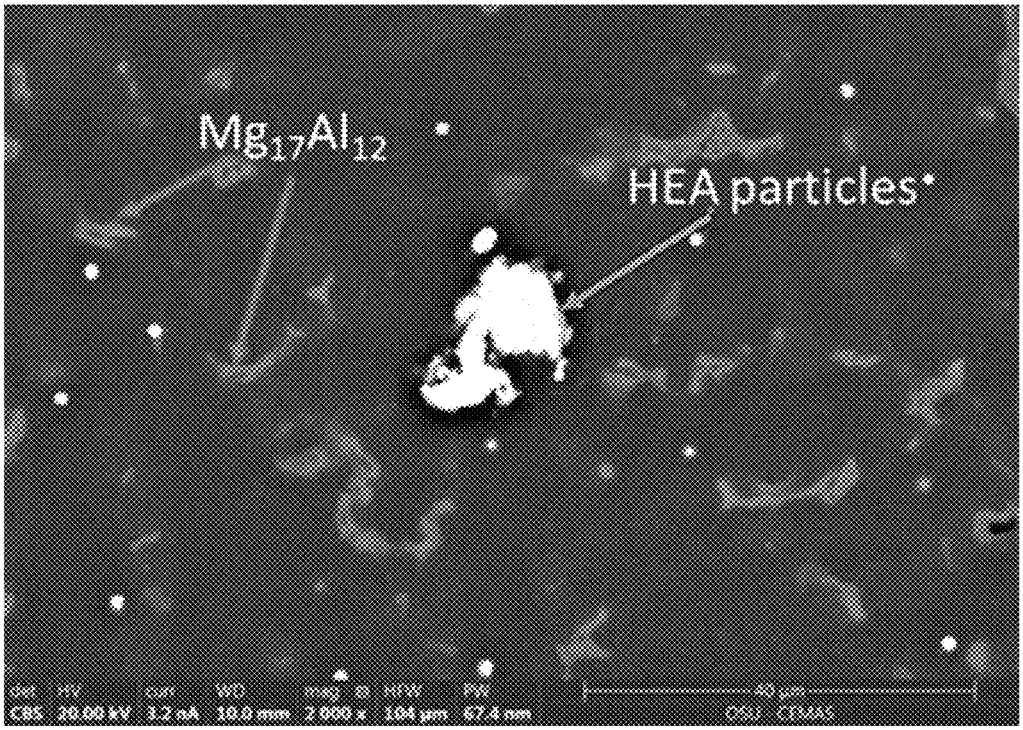
FIG. 18C. SEM image of the AZ91-AlCrTiV MMC sample.
Figure 19:
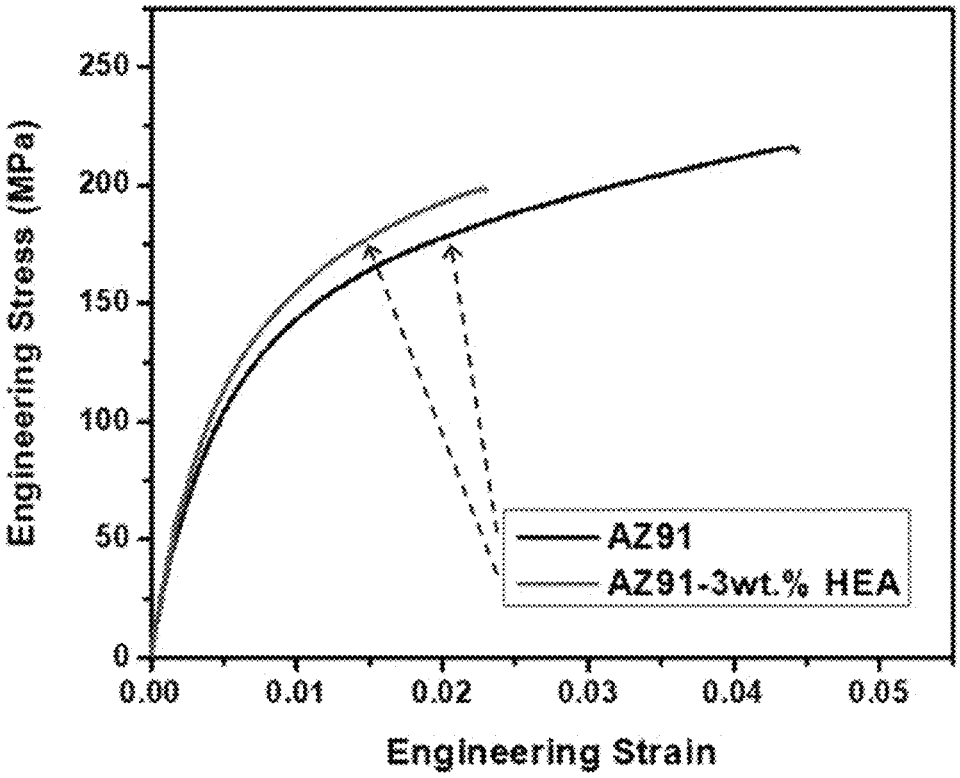
FIG. 19. Engineering stress-strain curves of AZ91 and AZ91-3 wt. % HEA composite.

Mg (AZ91)+HEA (AlCrTiV) MMC: FIG. 18A-FIG. 18B are optical micrographs of (FIG. 18A) Mg alloy (AZ91) and (FIG. 18B) AZ91-AlCrTiV MMC samples. FIG. 18C is a SEM image of the AZ91-AlCrTiV MMC sample. FIG. 19 shows typical mechanical properties of as-cast AZ91 alloy and AZ91-3 wt. % HEA MMC samples.

Other advantages which are obvious and which are inherent to the invention will be evident to one skilled in the art. It will be understood that certain features and sub-combinations are of utility and may be employed without reference to other features and sub-combinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The methods of the appended claims are not limited in scope by the specific methods described herein, which are intended as illustrations of a few aspects of the claims and any methods that are functionally equivalent are intended to fall within the scope of the claims. Various modifications of the methods in addition to those shown and described herein are intended to fall within the scope of the appended claims. Further, while only certain representative method steps disclosed herein are specifically described, other combinations of the method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

What is claimed is:

1. A method of making a metal matrix composite comprising a metal matrix reinforced by a high entropy alloy, the method comprising:

mixing a first powder and a second powder to form a powder mixture, wherein the first powder comprises a plurality of particles comprising a metal and the second powder comprises a plurality of particles comprising a high entropy alloy, wherein the metal is pure aluminum or an aluminum alloy;

compacting the powder mixture to form a pellet;

adding the pellet to a molten metal, the molten metal comprising the metal in a molten state, thereby melting the pellet to form a molten mixture;

subjecting the molten mixture to an ultrasonic treatment, thereby forming an ultrasonic treated mixture; and casting the ultrasonic treated mixture to form the metal matrix composite, the metal matrix composite having a final weight;

wherein the high entropy alloy is provided in an amount of from 1-30 wt. % relative to the final weight of the metal matrix composite.

2. The method of claim 1, wherein the powder mixture comprises the first powder and the second powder in a ratio of from 10:1 to 1:10 (weight: weight).

3. The method of claim 1, wherein the metal is an aluminum alloy.

4. The method of claim 3, wherein the metal is 7075 alloy.

5. The method of claim 1, wherein the metal is pure aluminum.

6. The method of claim 1, wherein the high entropy alloy is provided in an amount of from 1-10 wt. % relative to the final weight of the metal matrix composite.

7. The method of claim 1, wherein the high entropy alloy comprises AlCrTiV.

8. The method of claim 1, wherein the molten mixture is subjected to the ultrasonic treatment for an amount of time of from 1 second to 5 minutes.

9. The method of claim 1, wherein the ultrasonic treatment is applied by a device comprising an ultrasonic generator, a transducer, and a horn, and wherein the horn at least partially submerged in the molten mixture to transmit the ultrasonic treatment.

10. The method of claim 1, wherein the ultrasonic treatment disperses the plurality of particles comprising the high entropy alloy substantially uniformly in the molten mixture.

11. The method of claim 1, wherein the high entropy alloy is selected based on its wettability and/or interfacial bonding with the metal matrix.

* * * * *